US012735846B2

(12) United States Patent
Mettler

(10) Patent No.: US 12,735,846 B2
(45) Date of Patent: Sep. 15, 2026

(54) TEMPORARY WALKWAY SYSTEM WITH MODULAR TILES INTERLOCKING IN THREE-DIMENSIONS

(71) Applicant: Plastic Safety Systems, Inc., Cleveland, OH (US)

(72) Inventor: Charles M. Mettler, Perry, OH (US)

(73) Assignee: Plastic Safety Systems, Inc., Cleveland, OH (US)

( * ) Notice: Subject to any disclaimer, the term of this patent is extended or adjusted under 35 U.S.C. 154(b) by 282 days.

(21) Appl. No.: 18/688,102

(22) PCT Filed: Aug. 30, 2022

(86) PCT No.: PCT/US2022/041984

§ 371 (c)(1),
(2) Date: Feb. 29, 2024

(87) PCT Pub. No.: WO2023/034261

PCT Pub. Date: Mar. 9, 2023

(65) Prior Publication Data

US 2024/0360632 A1 Oct. 31, 2024

Related U.S. Application Data

(60) Provisional application No. 63/238,981, filed on Aug. 31, 2021.

(51) Int. Cl.
*E01C 9/08* (2006.01)
*A63H 33/06* (2006.01)
(Continued)

(52) U.S. Cl.
CPC ..... *E01C 9/086* (2013.01); *A63H 33/067* (2013.01); *A63H 33/082* (2013.01); *E01C 5/18* (2013.01);
(Continued)

(58) Field of Classification Search
CPC ..... E01C 9/086; E01C 5/18; E01C 2201/12; E04F 15/02022; E04F 2201/0153;
(Continued)

(56) References Cited

U.S. PATENT DOCUMENTS 3,657,852 A * 4/1972 Worthington ..... E04F 15/02 52/392
4,287,693 A 9/1981 Collette
(Continued)

FOREIGN PATENT DOCUMENTS

| | | |
|---|---|---|
| CN | 205976326 U | 2/2017 |
| EP | 2995747 B1 | 6/2020 |
| WO | 2005003574 A1 | 1/2005 |

OTHER PUBLICATIONS

International Search Report and Written Opinion mailed Dec. 15, 2022, for International Application No. PCT/US2022/041984.

*Primary Examiner* — Brent W Herring
(74) *Attorney, Agent, or Firm* — Renner, Otto, Boisselle & Sklar, LLP

(57) ABSTRACT

A modular tile for a walkway system interlocks with another tile to constrain movement of the interlocked tiles in all three-dimensions. The tile includes a male projection which may be tapered to provide lateral wings that are received in corresponding pockets of a female receiver of the other tile. The wings may include vertically-facing male stop surfaces that are engageable with vertically-facing female stop surfaces within the pockets. The male projection may further include a forwardly protruding ridge that is received in a corresponding groove of the female receiver of the other tile. The engagement of the stop surfaces of the wings and pockets, and the engagement of the ridge in the groove is such that the tiles are vertically interlocked with each other.
(Continued)

The tiles may be configured to enable a pivotable interlocking connection while one tile remains on the ground.

19 Claims, 17 Drawing Sheets

(51) Int. Cl.
*A63H 33/08* (2006.01)
*E01C 5/18* (2006.01)
*E04F 15/02* (2006.01)

(52) U.S. Cl.
CPC .. *E04F 15/02022* (2013.01); *E04F 15/02038* (2013.01); *E04F 15/02172* (2013.01); *E04F 15/02183* (2013.01); *E01C 2201/12* (2013.01); *E04F 2201/0153* (2013.01); *E04F 2201/035* (2013.01); *E04F 2201/091* (2013.01); *E04F 2201/095* (2013.01); *E04F 2201/098* (2013.01)

(58) Field of Classification Search
CPC ..... E04F 2201/035; E04F 2201/091; E04F 2201/096; E04F 2201/098; E04F 15/02038; E04F 15/02172; E04F 15/02183; E04F 15/10; E04F 2201/095; A63H 33/067; A63H 33/086; A63H 33/082
See application file for complete search history.

(56) References Cited

U.S. PATENT DOCUMENTS

| | | | | |
|---|---|---|---|---|
| 5,630,304 | A * | 5/1997 | Austin | E04F 15/10 52/592.1 |
| 6,526,705 | B1 * | 3/2003 | MacDonald | E04F 15/02 428/44 |
| 7,340,865 | B2 * | 3/2008 | Vanderhoef | E04F 15/02194 52/177 |
| 7,849,642 | B2 * | 12/2010 | Forster | E01C 9/086 52/180 |
| 8,534,023 | B2 * | 9/2013 | Zhu | E04F 15/02 52/588.1 |
| 8,925,264 | B2 * | 1/2015 | Thrush | E04F 15/105 52/177 |
| 12,000,154 | B2 * | 6/2024 | Pressnell | E01C 5/20 |
| 2005/0166513 | A1 * | 8/2005 | Vanderhoef | E04F 15/105 52/578 |
| 2005/0223666 | A1 * | 10/2005 | Forster | E04F 15/10 52/592.1 |
| 2012/0240506 | A1 * | 9/2012 | Zhu | E04F 15/02 52/588.1 |
| 2012/0304566 | A1 * | 12/2012 | Thrush | E04F 15/105 52/302.1 |
| 2023/0203822 | A1 * | 6/2023 | Pressnell | E01C 5/20 52/177 |

* cited by examiner

TEMPORARY WALKWAY SYSTEM WITH MODULAR TILES INTERLOCKING IN THREE-DIMENSIONS

RELATED APPLICATIONS

The application is a national phase of International Patent Application No. PCT/US2022/041984, filed Aug. 30, 2022, which claims the benefit of U.S. Provisional Patent Application No. 63/238,981, filed Aug. 31, 2021, each of which is hereby incorporated herein by reference in its entirety.

TECHNICAL FIELD

The present invention relates generally to walkway systems, and more particularly to a modular interlocking tile for such walkway systems.

BACKGROUND

Temporary walkways are a type of portable outdoor flooring that can be installed and uninstalled repeatedly, usually without machinery, adhesives, or underflooring. Many conventional walkway systems use a series of modular tiles that can be interconnected to form the walkway along a desired path. There are many different types of such modular tiles, which may be formed in various shapes and sizes, or may be made with different types of materials depending on the application. Such walkway systems typically are suitable for use indoors or outdoors, and can be used with pedestrian or vehicle traffic.

SUMMARY

One problem with conventional temporary walkway systems is that the interconnecting functionality of the modular tiles is limited to constraining movement in only two-dimensions in a horizontal plane. These conventional tiles do not additionally provide interlocking functionality in the vertical direction without the use of separate fasteners, adhesives, or the like.

An aspect of the present disclosure provides a unique modular tile for a walkway system that interlocks with an adjacent tile to provide vertical interlocking functionality in addition to horizontal interlocking functionality, thereby constraining movement of the interlocked tiles in all three orthogonal dimensions without the use of additional discrete elements such as fasteners, adhesives, or the like.

An exemplary modular tile provides a unique cooperating male projection and female receiver arrangement that enables such three-dimensional interlocking functionality. The male projection and female receiver arrangement may provide an easy to assemble and disassemble a modular walkway system that can be manufactured at low cost.

According to one aspect, an exemplary walkway system includes a plurality of tiles interlocked together via at least one joint, the at least one joint having at least one male locking element and at least one female locking element in juxtaposed relationship including juxtaposed axially overlapping sections, juxtaposed laterally overlapping sections, and juxtaposed vertically overlapping sections that interlock the plurality of tiles in all three dimensions.

According to another aspect, a modular tile for a walkway system is configured to interlock with another tile to constrain movement of the interlocked tiles in all three-dimensions. The tile includes a male projection that extends from the body of the tile in an axial direction, expanding laterally toward its distal end for receipt in a correspondingly-shaped female receiver in the other tile. The male projection may be tapered to provide lateral wings that are received in corresponding pockets of the female receiver of the other tile. The wings may include vertically-facing male stop surfaces that are engageable with vertically-facing female stop surfaces within the pockets. The male projection may further include a forwardly-protruding ridge that is received in a corresponding groove of the female receiver of the other tile. The engagement of the stop surfaces of the wings and pockets, and the engagement of the ridge in the groove is such that the tiles are vertically interlocked with each other to constrain vertical movement of each tile. The tiles may be configured to enable a pivotable interlocking connection while one tile remains on the ground.

According to another aspect, a modular interlocking tile includes: at least one male projection that projects horizontally in a longitudinally forward direction from a front edge of the tile, the male projection having a rearwardly facing male engagement surface, opposite laterally-facing male engagement surfaces, and a vertically-facing male stop surface; at least one female receiver that is recessed in the longitudinally forward direction from a rear edge of the tile, the female receiver having a forwardly-facing female engagement surface, opposite laterally-facing female engagement surfaces, and at least one vertically-facing female stop surface that faces in an opposite vertical direction of the vertically-facing male stop surface; wherein the tile is adapted to interlockingly connect with another tile, such that: (i) the rearwardly-facing male engagement surface of the tile is engageable with the forwardly-facing female engagement surface of the other tile to interlock the tiles in the longitudinal direction in a horizontal plane, (ii) the opposite laterally-facing male engagement surfaces of the tile are respectively engageable with the opposite laterally-facing female engagement surfaces of the other tile to interlock the tiles in the lateral direction in the horizontal plane perpendicular to the longitudinal direction, and (iii) the vertically-facing male stop surface of the tile is engageable with the vertically-facing female stop surface of the other tile to interlock the tiles in the vertical direction, perpendicular to the horizontal plane.

According to another aspect, a modular interlocking tile for a walkway system includes: a lower surface, an upper surface, a front edge, a rear edge, and lateral side edges extending between respective ends of the front edge and the rear edge, the lower and upper surfaces extending horizontally, and the front, rear and lateral side edges extending vertically to operatively connect the upper and lower surfaces; at least one male projection that horizontally projects in a longitudinally forward direction from the front edge, the male projection having a narrow male portion proximal the front edge and a wide male portion distal the front edge, the narrow male portion being narrower in a laterally horizontal direction than the wide male portion, such that the wide male portion forms at least one wing on at least one lateral side of the male projection, wherein the male projection further includes a locking protrusion that horizontally extends forwardly from a front edge of the wide male portion, the locking protrusion including a protrusion stop surface that at least partially faces vertically; at least one female receiver that is horizontally recessed in the longitudinally forward direction from the rear edge, the female receiver having a narrow female portion proximal the rear edge and a wide female portion distal the rear edge, the narrow female portion being narrower in the laterally horizontal direction than the wide female portion, such that the wide female portion forms at least one open pocket on at least one lateral side of the female receiver, wherein the female receiver further includes a groove that horizontally extends in the longitudinally forward direction relative to the wide female portion, the groove having a groove stop surface that at least partially faces vertically in an opposite vertical direction than the protrusion stop surface; wherein the tile is adapted to interlockingly connect with another tile, such that: (i) the at least one wing of the male projection of the tile is receivable in the at least one pocket of the female receiver of the other tile to interlock the tiles in the longitudinal and lateral directions along horizontal, and (ii) the protrusion stop surface of the tile is engageable with the groove stop surface of the other tile to interlock the tiles in the vertical direction.

According to another aspect, a modular interlocking tile for walkway system includes: a lower surface, an upper surface, a front edge, a rear edge, and lateral side edges extending between respective ends of the front edge and the rear edge, the lower and upper surfaces extending horizontally, and the front, rear and lateral side edges extending vertically to operatively connect the upper and lower surfaces; at least one tapered male projection that horizontally projects in a forward longitudinal direction from the front edge and horizontally tapers in a rearward longitudinal direction from a wide male portion to a narrow male portion of the male projection, the wide male portion forming wings on opposite lateral sides of the male projection, each wing being beveled in an upward vertical direction to reduce the thickness of each wing in its laterally outward direction and forming a downwardly and laterally outwardly facing wing stop surface at an elevation in a vertical direction between an upper and lower surface of the male projection, wherein the male projection further includes a laterally extending ridge that horizontally projects forwardly from a front edge of the wide male portion, the ridge having a thickness in the vertical direction that is less than a maximum thickness of the wide male portion and being located at a lower portion of the male projection, the ridge forming a upwardly facing ridge stop surface at an elevation in the vertical direction between the upper and lower surface of the male projection, the ridge stop surface being longitudinally offset in the forward direction from the wing stop surface; at least one tapered female receiver that is recessed in the forward direction from the rear edge and horizontally tapers in the rearward direction from a wide female portion to a narrow female portion of the female receiver, the wide female portion forming open pockets on opposite lateral sides of the female receiver, each pocket having a floor within at least part of the pocket that is beveled in an upward vertical direction to reduce the depth of the pocket in its laterally outward direction and forming an upwardly and laterally inwardly facing pocket stop surface at an elevation in the vertical direction within the pocket, wherein the female receiver further includes a notch in a lower portion of the tile that extends in the forward direction relative to the wide female portion, the notch forming a downwardly facing notch stop surface, wherein the notch stop surface is longitudinally offset in the forward direction from the pocket stop surface.

The following description and the annexed drawings set forth certain illustrative embodiments of the invention. These embodiments are indicative, however, of but a few of the various ways in which the principles of the invention may be employed. Other objects, advantages and novel features according to aspects of the invention will become apparent from the following detailed description when considered in conjunction with the drawings.

BRIEF DESCRIPTION OF THE DRAWINGS

The annexed drawings, which are not necessarily to scale, show various aspects of the invention.

DETAILED DESCRIPTION

Figure 1:
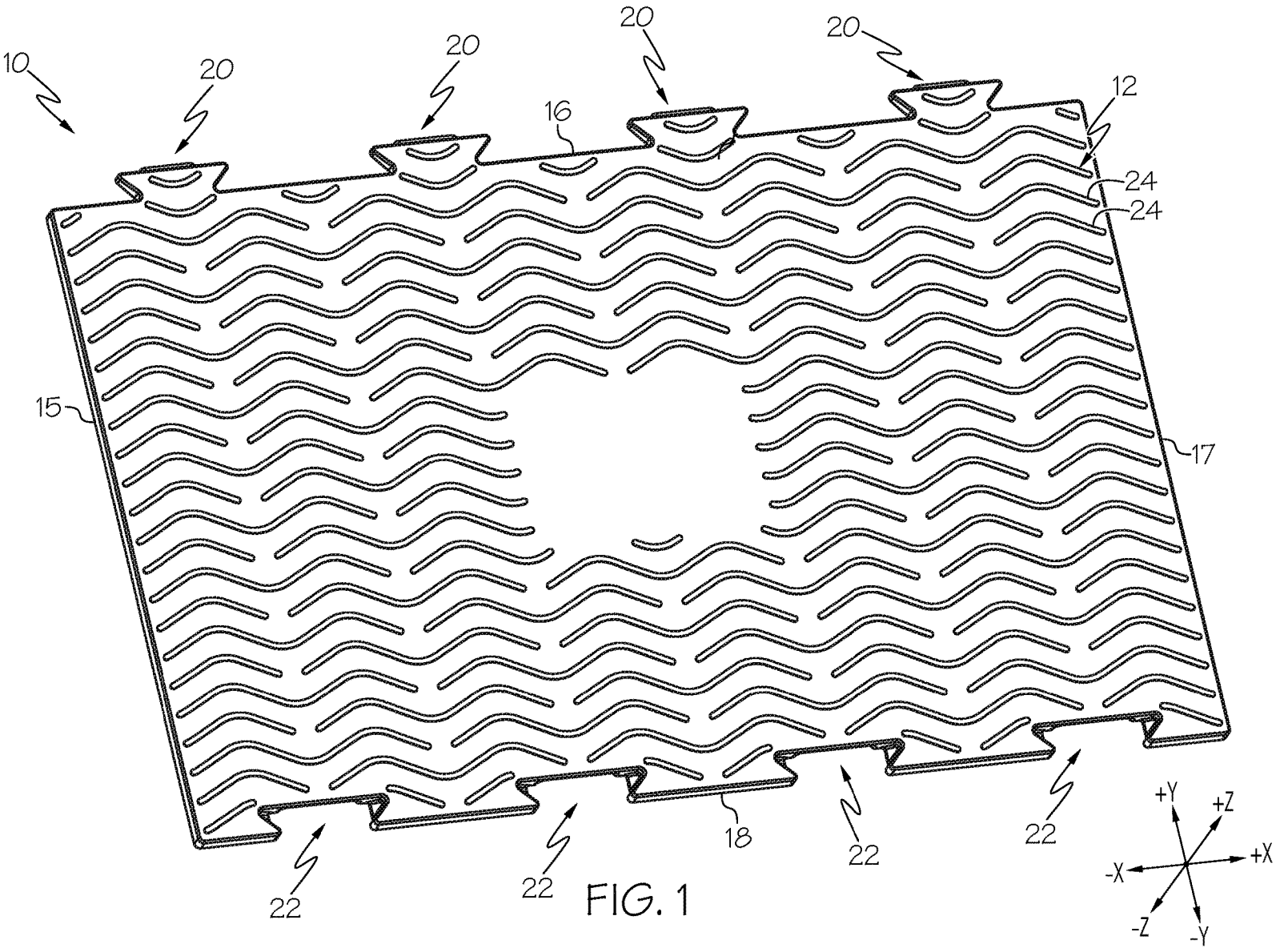
FIG. 1 is a perspective top, left, rear view of an exemplary modular interlocking tile according to an embodiment.
Figure 2:
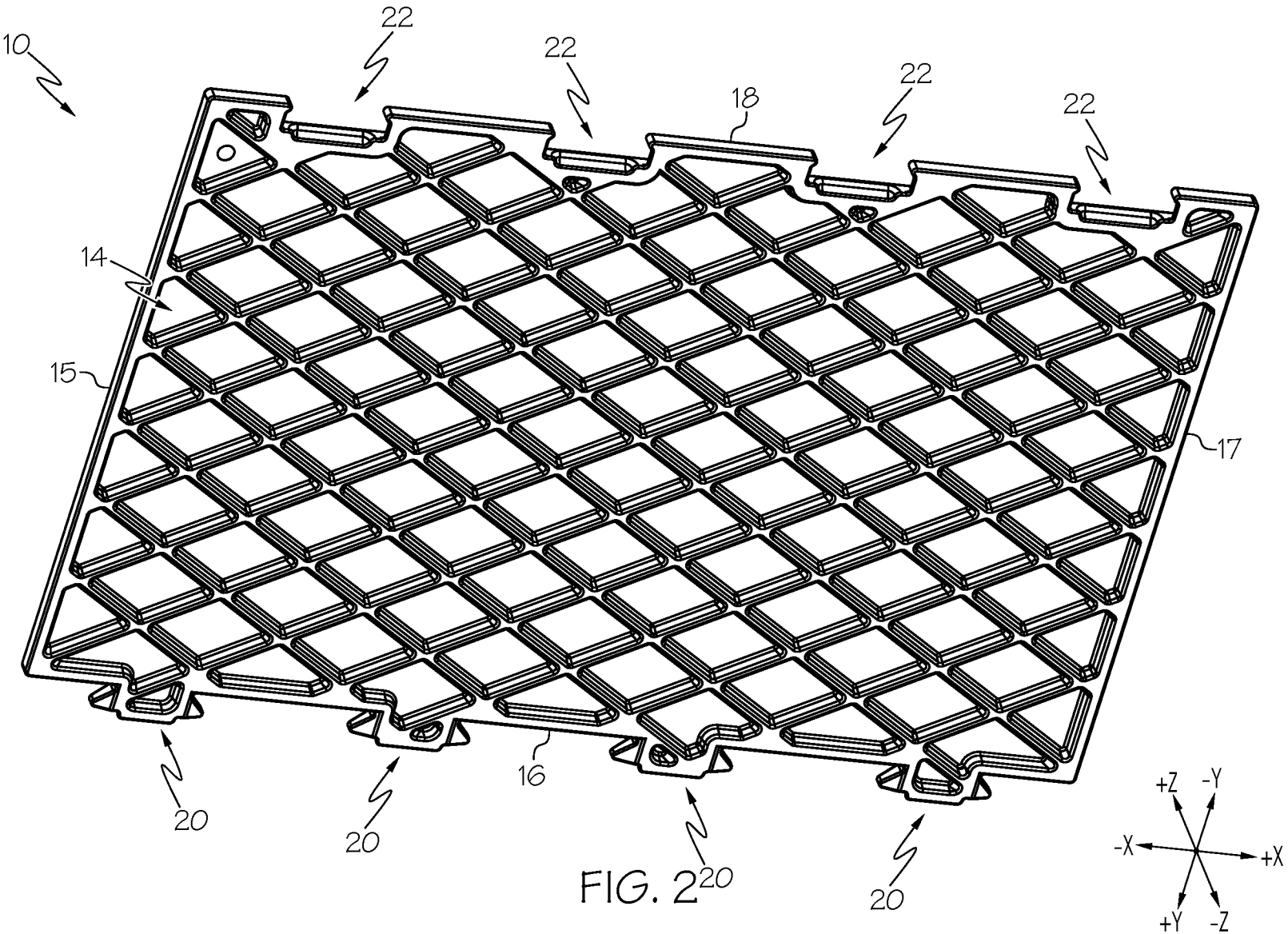
FIG. 2 is a perspective bottom, left, rear view of the tile in FIG. 1.
Figure 3:
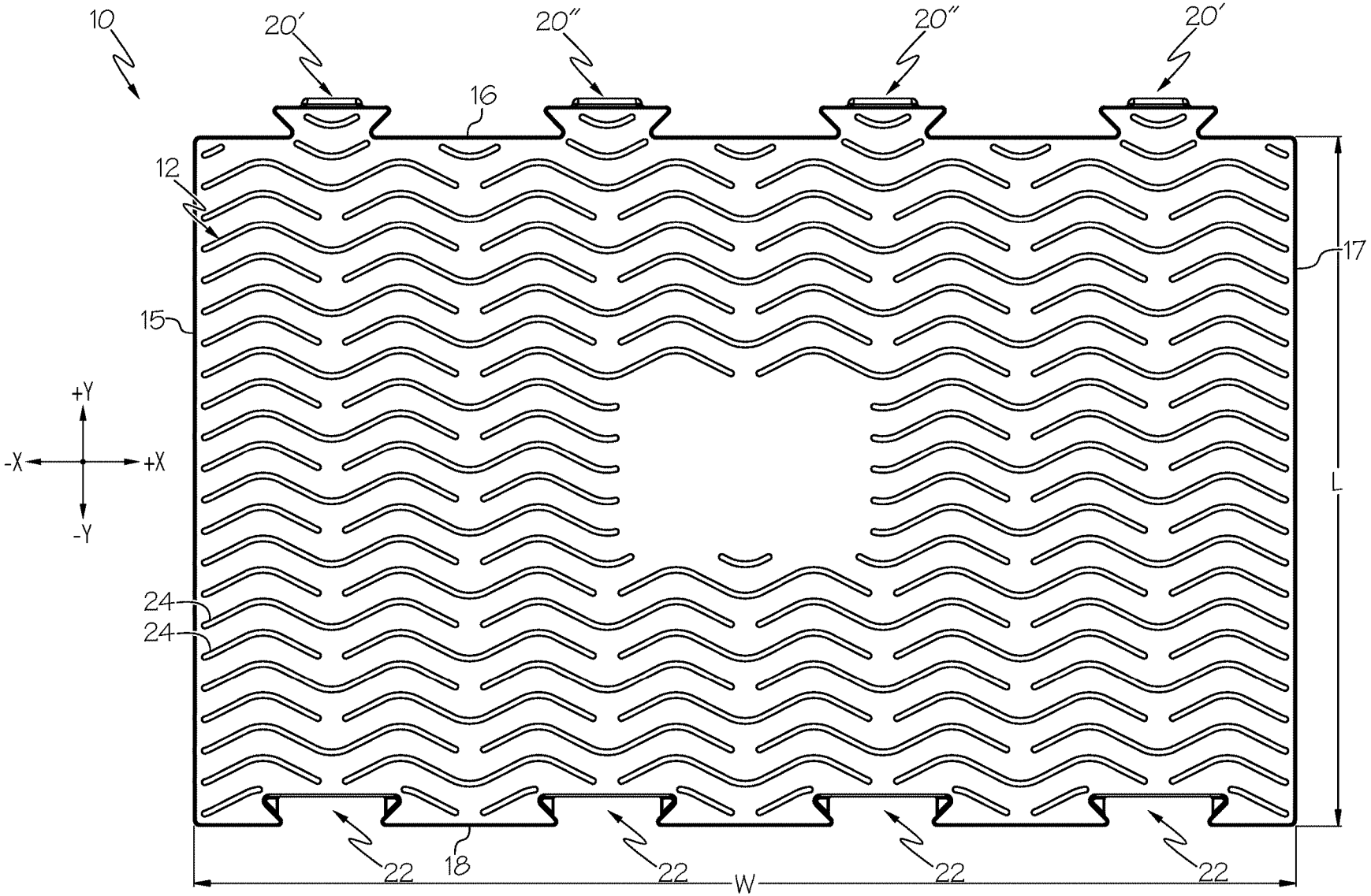
FIG. 3 is a top plan view of the tile in FIG. 1.
Figure 4:
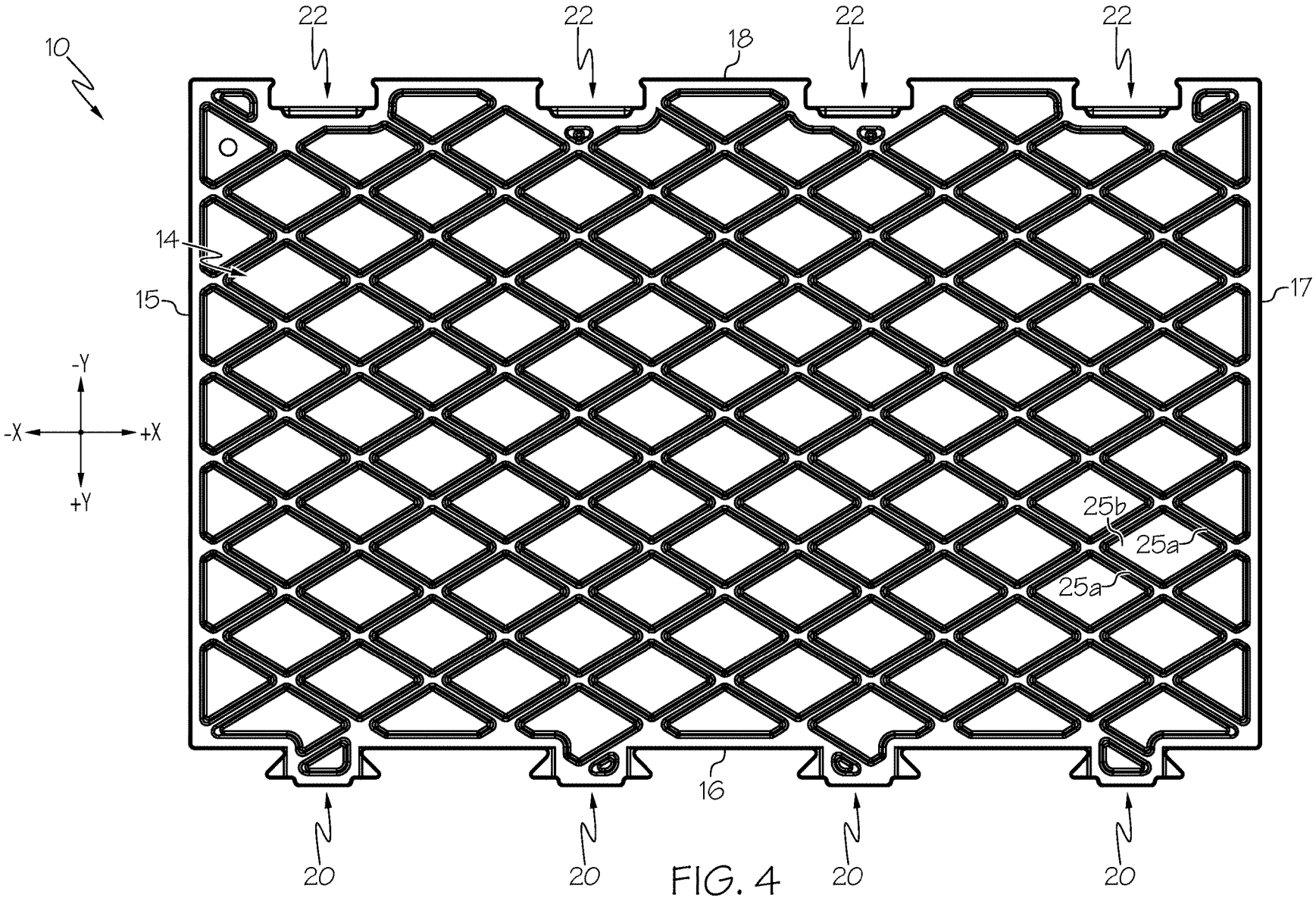
FIG. 4 is a bottom plan view of the tile in FIG. 1.
Figure 5:
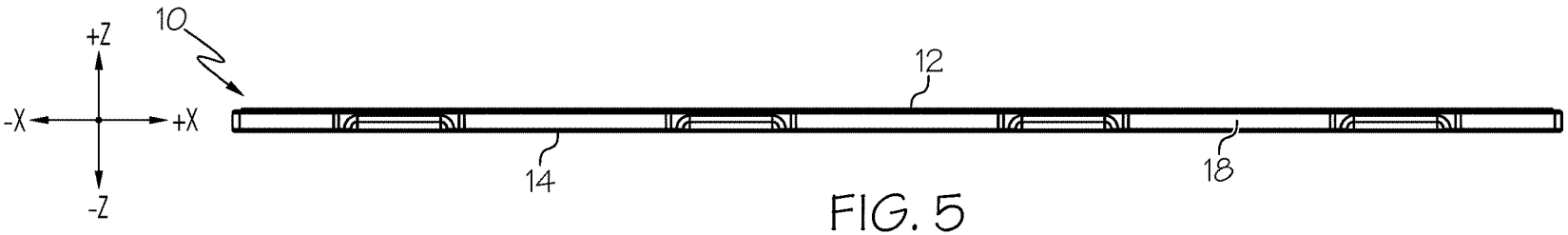
FIG. 5 is a rear elevation view of the tile in FIG. 1.
Figure 6:
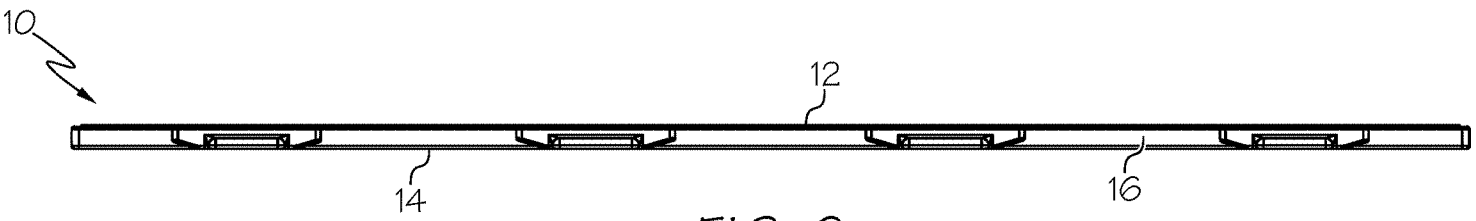
FIG. 6 is a front elevation view of the tile in FIG. 1.
Figure 7:
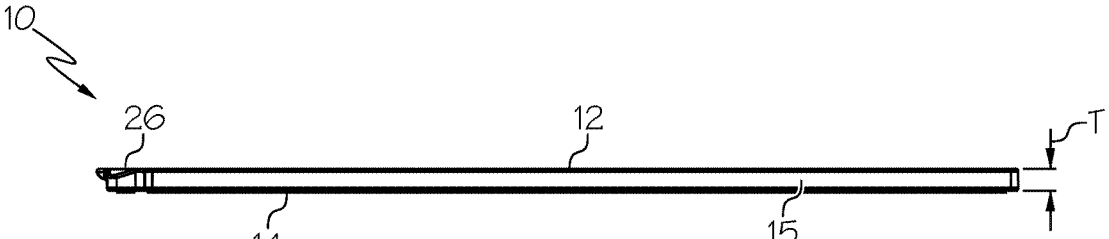
FIG. 7 is a left side elevation view of the tile in FIG. 1.
Figure 8:
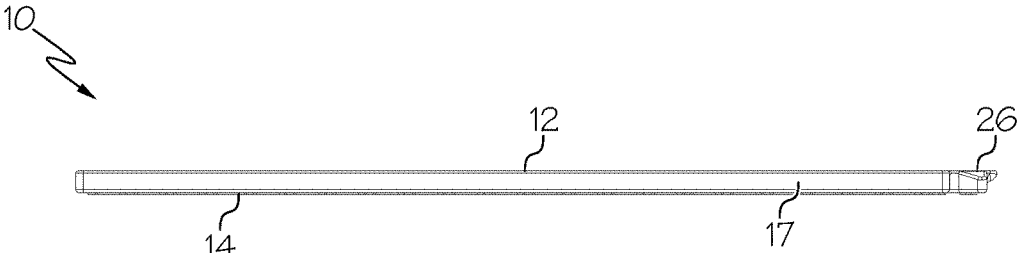
FIG. 8 is a right side elevation view of the tile in FIG. 1.
Figure 9:
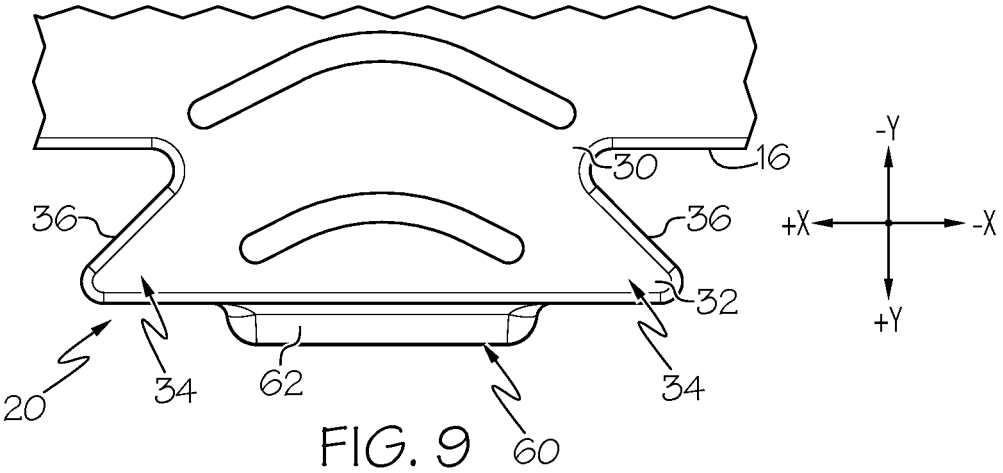
FIG. 9 is an enlarged top plan view of an exemplary male projection of the tile shown in FIG. 1.
Figure 10:
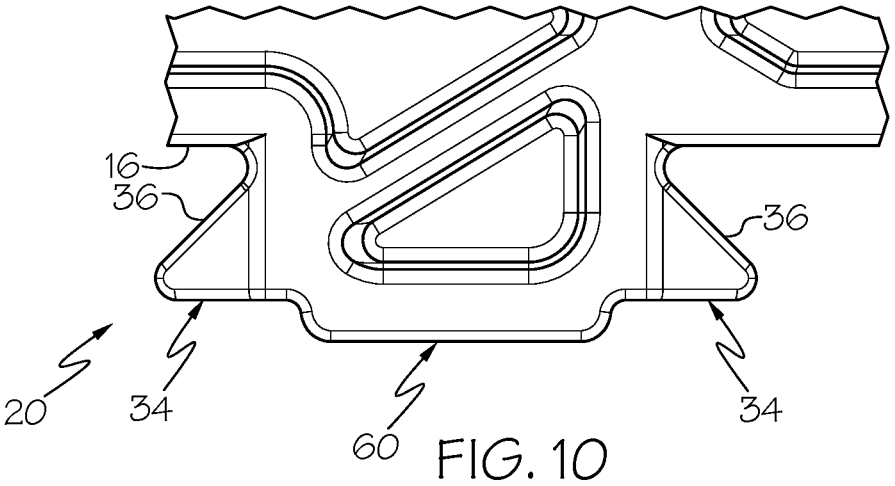
FIG. 10 is an enlarged bottom plan view of the male projection shown in FIG. 9.
Figure 11:
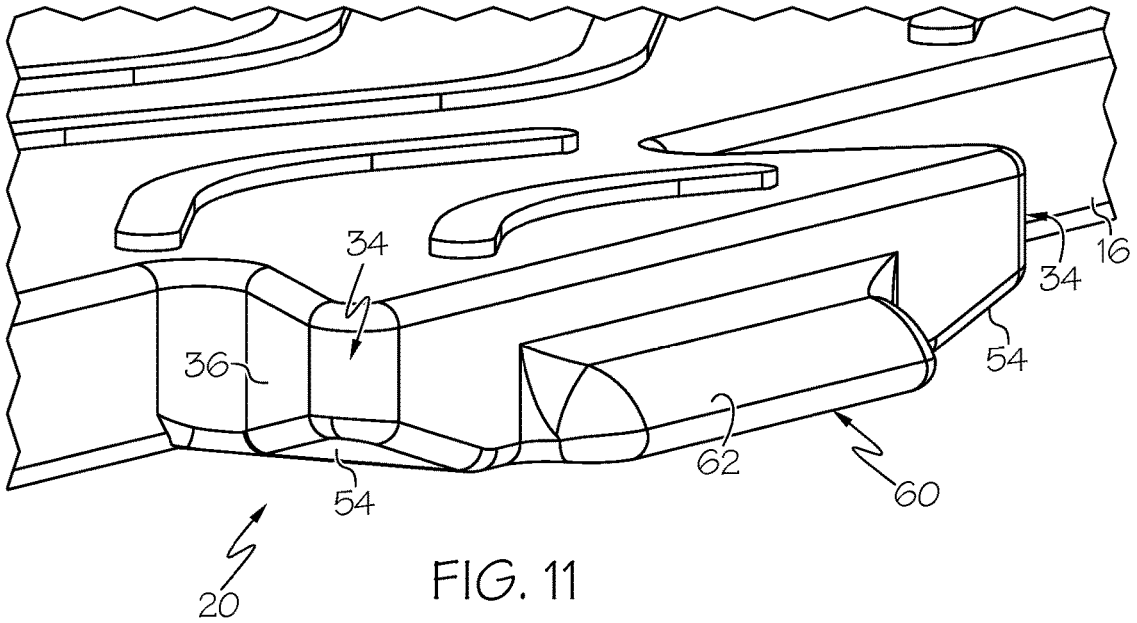
FIG. 11 is a top, front, right perspective view of the male projection shown in FIG. 9.
Figure 12:
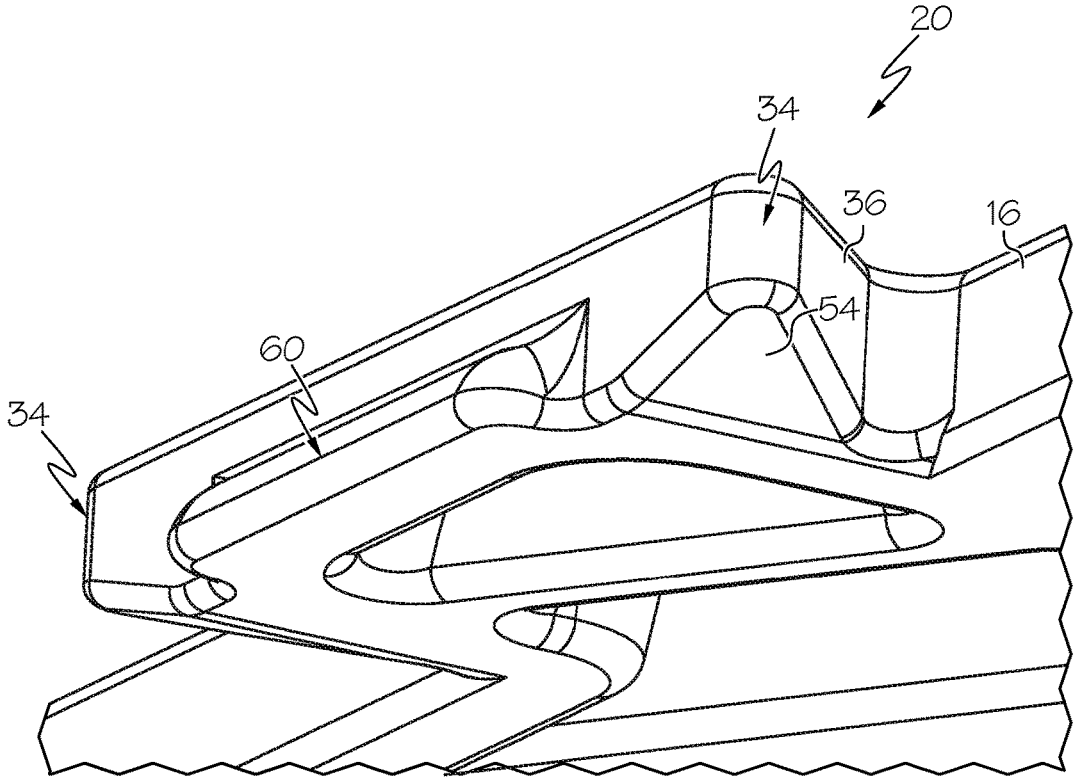
FIG. 12 is a bottom, front, left perspective view of the male projection shown in FIG. 9.
Figure 13:
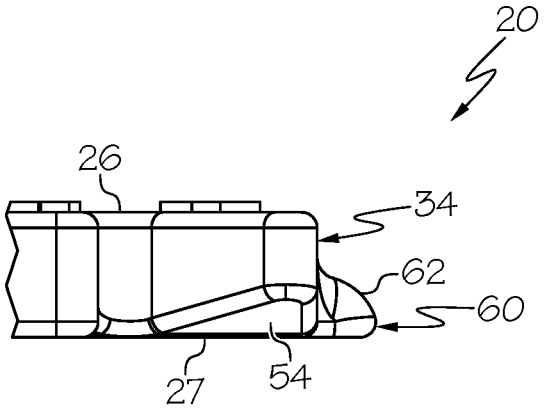
FIG. 13 is an enlarged right side elevation view of the male projection shown in FIG. 9.
Figure 14:
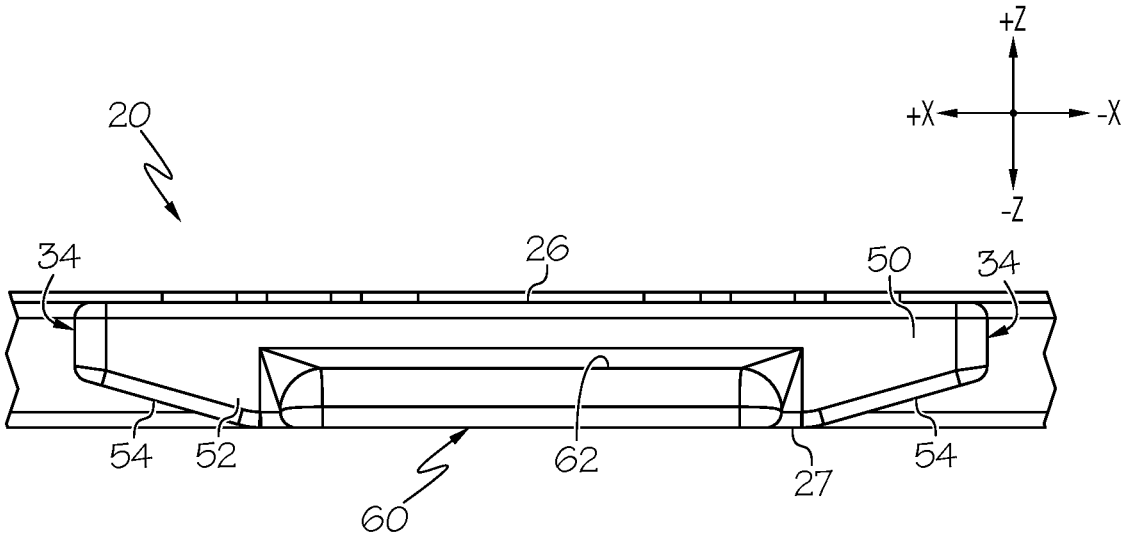
FIG. 14 is an enlarged front elevation view of the male projection shown in FIG. 9.
Figure 15:
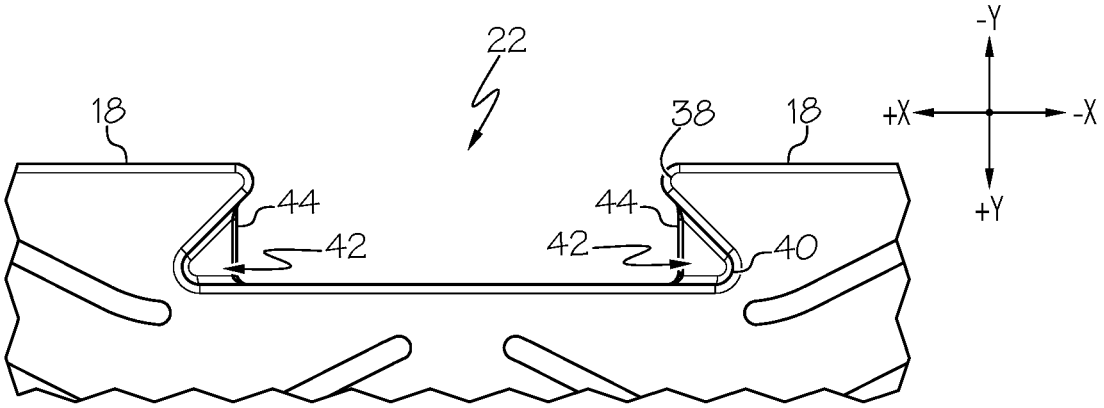
FIG. 15 is an enlarged top plan view of an exemplary female receiver of the tile shown in FIG. 1.
Figure 16:
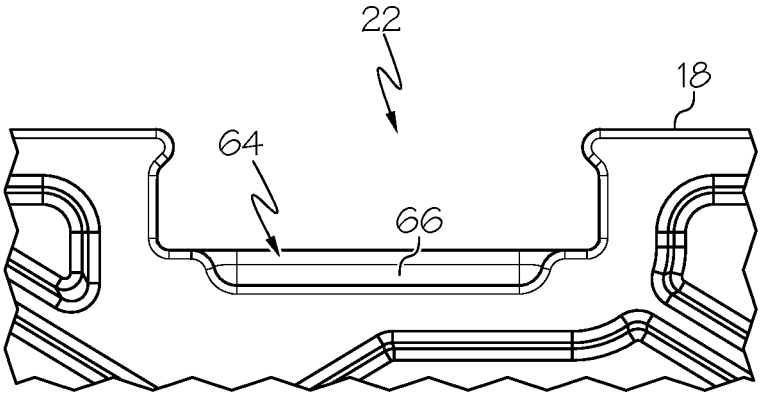
FIG. 16 is an enlarged bottom plan view of the female receiver shown in FIG. 15.
Figure 17:
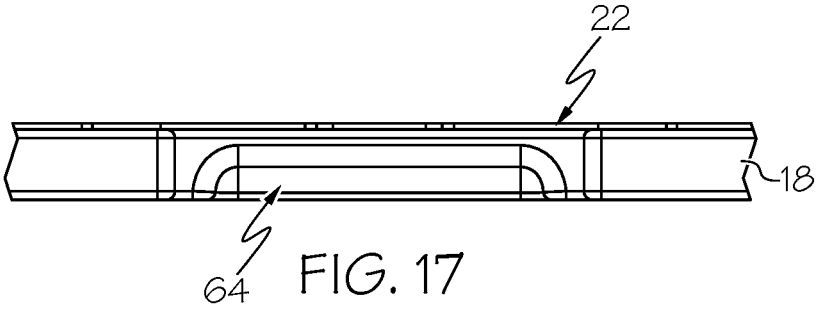
FIG. 17 is an enlarged rear elevation view of the female receiver shown in FIG. 15.
Figure 18:
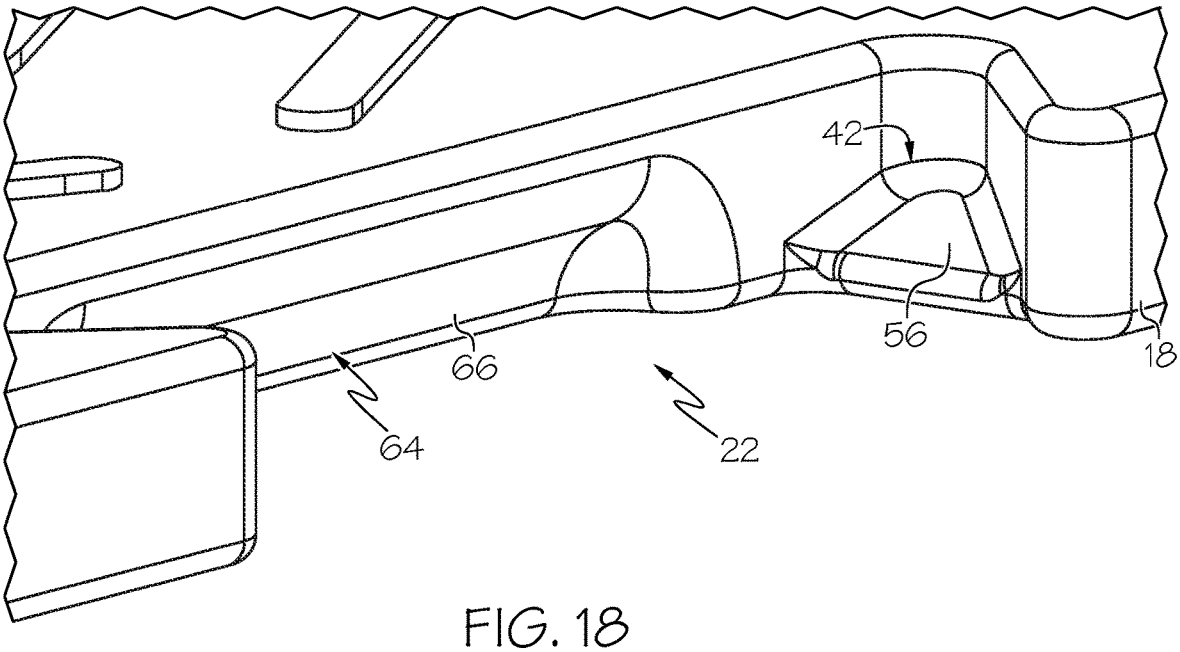
FIG. 18 is a top, rear, left perspective view of the female receiver shown in FIG. 15.
Figure 19:
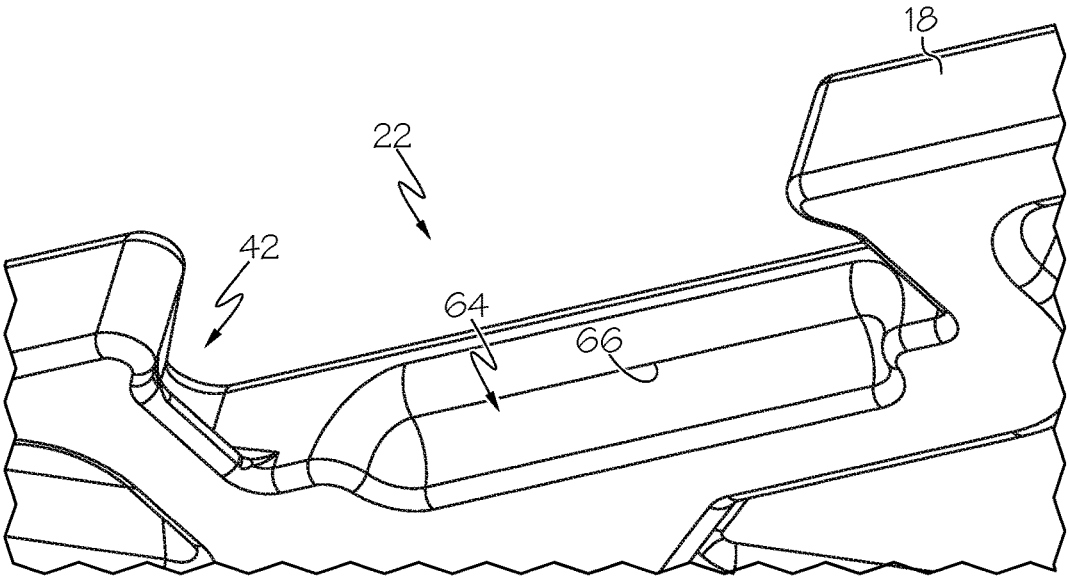
FIG. 19 is a bottom, rear, right perspective view of the female receiver shown in FIG. 15.

An aspect of the present disclosure provides a unique modular tile for a walkway system that interlocks with another adjacent tile to provide vertical interlocking functionality in addition to two-dimensional horizontal interlocking functionality, which enables constraint of the interlocked tiles in all three orthogonal dimensions without the use of additional discrete elements such as fasteners, adhesives, or the like.

As described in further detail below, an exemplary modular tile provides a unique cooperating male projection and female receiver arrangement that enables the three-dimensional interlocking functionality. The arrangement generally includes the male projection having at least a rearwardly-facing male engagement surface, opposite laterally-facing male engagement surfaces, and at least one vertically-facing male stop surface. In addition, the female receiver generally includes at least a forwardly-facing female engagement surface, opposite laterally-facing female engagement surfaces, and at least one vertically-facing female stop surface, each of which oppose and are engageable with the corresponding surfaces of the male projection.

Generally, when adjacent tiles are interlocked with each other, the rearwardly-facing male engagement surface of one tile is engageable with the forwardly-facing female engagement surface of the other tile to interlock the adjacent tiles in the longitudinal direction in the horizontal plane to prevent separation. The opposite laterally-facing male engagement surfaces of the tile are respectively engageable with the opposite laterally-facing female engagement surfaces of the other tile to interlock the tiles in the lateral direction in the horizontal plane, perpendicular to the longitudinal direction. In addition, the at least one vertically-facing male stop surface of the tile is engageable with the at least one vertically-facing female stop surface of the other tile to constrain movement of at least one of the tiles in the vertical direction. In preferred embodiments, each of the male projection and female receiver further include another vertically-facing stop surface that faces in an opposite vertical direction of the first vertically-facing stop surface, which constrains vertical movement of each interlocked tile, as described in further detail below.

Since the principles and aspects according to the present disclosure have particular application to interlocking tiles for temporary walkway systems, the present disclosure is described below chiefly in this context, although the principles and aspects may be applicable to other types of products or other types of systems, or a combination thereof, in which the unique interlocking technology described herein may be employed.

Referring generally to FIGS. 1-8, an exemplary embodiment of a modular interlocking tile 10 for a walkway system is shown. The modular interlocking tile generally includes an upper tread surface 12, a lower ground engagement surface 14, and respective side edges 15, 16, 17, 18 interconnecting the upper and lower surfaces 12, 14 around the perimeter of the upper and lower surfaces 12, 14. The modular interlocking tile 10 also includes a unique arrangement of at least one male projection 20 and at least one female receiver 22 that provides three-dimensional interlocking functionality when the male projection 20 of the tile 10 is interlockingly received in the female receiver 22 of another tile 10. The three-dimensional interlocking functionality provided by interlocking such tiles 10 includes constraining movement relative to each other in a lateral (horizontal) direction (X), a longitudinal (horizontal) direction (Y), and a vertical direction Z. In exemplary embodiments, the unique juxtaposed arrangement of respective engagement surfaces of the male projection 20 and female receiver 22 of the interlocked tiles constrains movement in all six perpendicular degrees of freedom, including lateral left (−X), lateral right (+X), longitudinal forward (+Y), longitudinal rearward (−Y), vertical upward (+Z), and vertical downward (−Z). This can be accomplished in an easy to install and uninstall design without the use of fasteners, adhesives, or the like, as described in further detail below.

As shown in the illustrated embodiment, the upper surface 12 and the lower surface 14 form a major body portion of the tile 10 that lies in a horizontal plane (along X and Y directions). The upper surface 12 may include treads 24, such as vertically protruding ridges or ribs or vertically extending recesses. The lower surface 14 also may include treads, which are formed as ribs 25*a* surrounding recessed areas 25*b* in the lower surface 14. The ribs 25*a* and corresponding recessed areas 25*b* provide suitable rigidity and strength while also reducing weight.

The respective edges 15, 16, 17, 18 of the tile 10 extend vertically (in the Z direction) to connect the upper and lower surfaces 12, 14 about the perimeter of the upper and lower surfaces 12, 14. In the illustrated embodiment, the edges 15-18 of the tile are perpendicular to the horizontal plane, although it is understood that one or more of the vertically extending edges could be inclined, curved, or the like. Likewise, the upper surface 12 and the lower surface 14 are shown as planar horizontal surfaces that are parallel to each other, although these surfaces also could be inclined, curved, or the like. In exemplary embodiments, the tile 10 is formed in a generally rectangular shape (as shown) with a major portion width (W) in the lateral (X) direction greater than its major portion length (L) in the longitudinal (Y) direction (see FIG. 3), both of which are greater than its major portion thickness (T) in the vertical (Z) direction (see FIG. 7). It is understood, however, that the tile 10 could have other suitable shapes or forms, including other polygonal shapes, or curved or irregular shapes, as may be desired for a particular application.

The overall dimensions of the tile may be adapted for the particular application. For example, in pedestrian applications, each modular tile of the walkway system may have the major portion width (W) in a range from about 36 inches (about 91 cm) to about 54 inches (about 137 cm), such as about 48 inches (about 122 cm), which may be suitable for satisfying certain requirements of wheelchair accessibility. The major portion length (L) of the rectangular tile 10 for such pedestrian use may be in a range from about 24 inches to about 42 inches (about 61 cm to about 107 cm), such as about 30 to 36 inches (about 76 to 91 cm) for example. The major portion thickness (T) of the tile may be sized to minimize weight while also providing sufficient strength to resist excessive flexure or fracture depending on the material selected for the tile. For example, in exemplary embodiments, the thickness of the tile may be in a range from about 0.25 inch (about 6 mm) to about 1.0 inch (about 25 mm), such as about 0.5 inch (about 13 mm) to about 0.75 inch (about 19 mm) in thickness.

The tile 10 may be made of any suitable material or combination of materials, which may be selected based on the manufacturability, size, weight, or cost of the tile 10. For example, in exemplary embodiments, the tile 10 is made of a rubber-based material, such as reclaimed rubber. The rubber-based material may be formed via any suitable technique, such as by thermal compression molding the rubber-based material into the shape of the tile 10, with or without additional machining.

As shown in the illustrated embodiment, the at least one male projection 20 extends in the longitudinally forward direction (+Y) from at least one edge 16 of the tile 10 (arbitrarily referred to as the front edge 16, or male side, in the illustrated embodiment). In exemplary embodiments, the tile 10 includes a plurality of male projections 20 along the front edge 16 to enhance interlocking functionality. In the illustrated embodiment, for example, four male projections 20 are provided, including a set of laterally outer male projections and a set of inner male projections laterally inwardly-spaced relative to the outer male projections. The male projections 20 each may be the same, or some of the male projections 20 may be different. For example, in the illustrated embodiment, the laterally outer male projections (20' in FIG. 3) have an identical configuration to the inner male projections (20" in FIG. 3), but the laterally outer male projections 20' are slightly larger in width (along the X direction) than the inner male projections 20" (e.g., about 5% to 10% larger). This slight difference in size provides greater misalignment tolerance for the inner male projections 20" to account for manufacturing variances (e.g., shrinkage of the tile) while still allowing for proper alignment and interlocking functionality of all male projections 20 with the female receivers 22 of an adjacent tile.

Figure 20A:
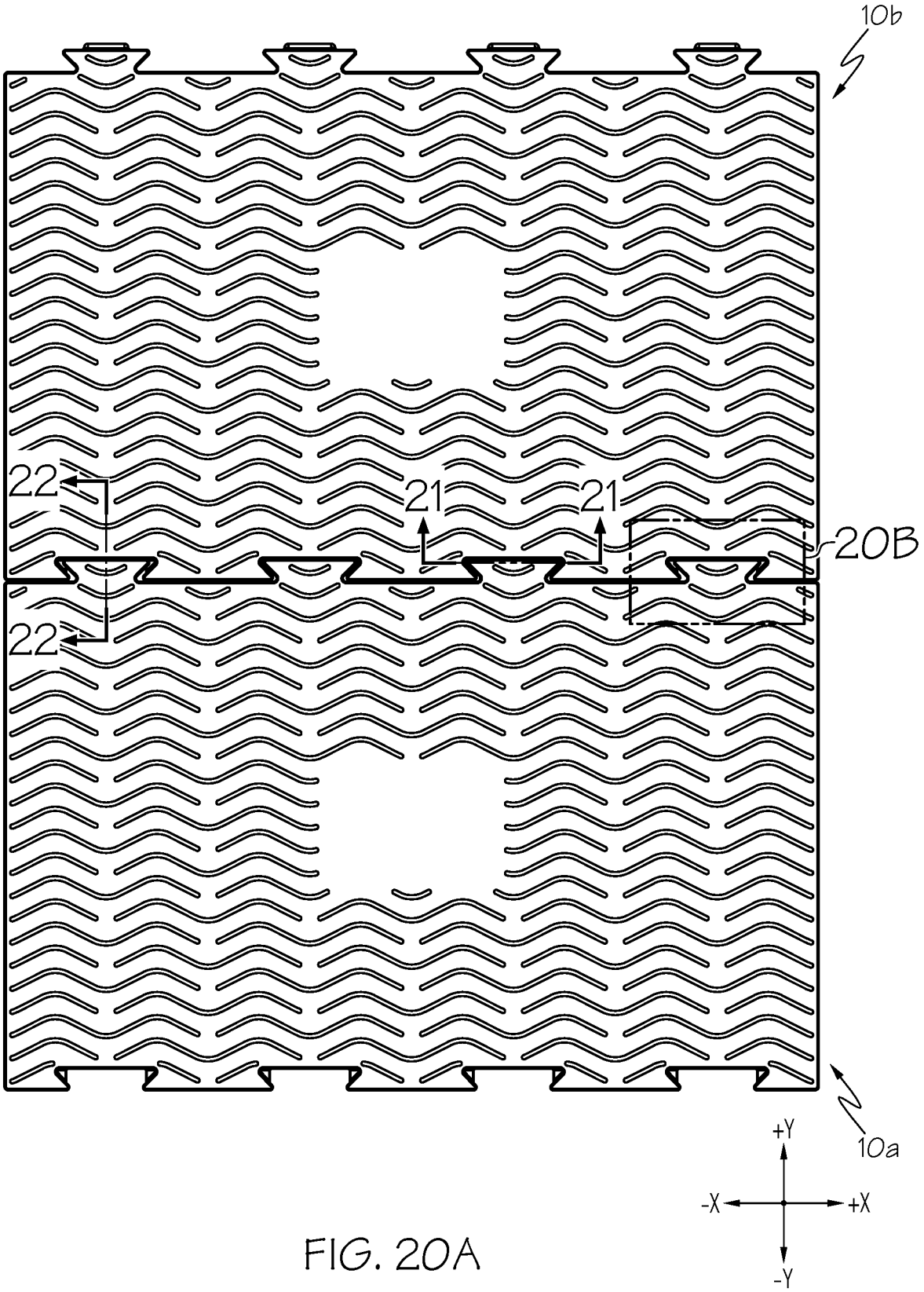
FIG. 20A is a top plan view of the tile in FIG. 1 interlocked with another tile.
Figure 20B:
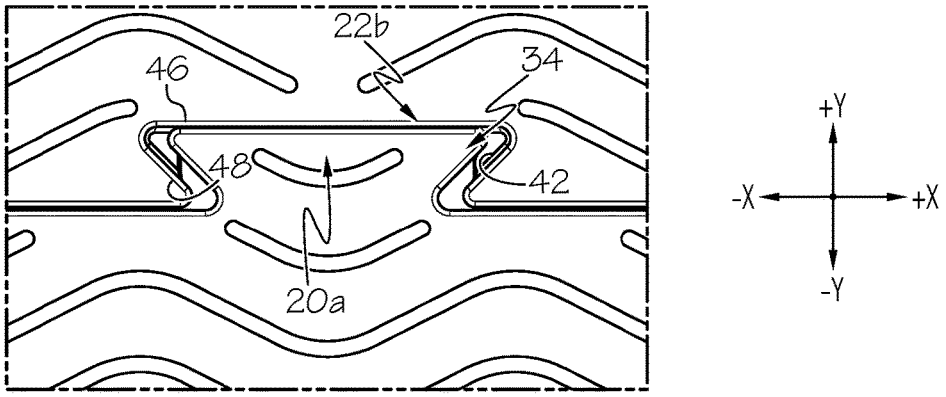
FIG. 20B is an enlarged view taken from the section shown in FIG. 20A.

The female side of the tile 10 is opposite the male side and includes the same number of female receivers 22 as male projections 20. As shown, the female receivers 22 are recessed in the longitudinally forward direction (+Y) from a rear edge 18 of the tile 10 and are adapted to receive the corresponding male projections 20 of another tile (as shown in FIGS. 20A and 20B). Similarly to the male projections 20, the female receivers 22 may be the same, or some may be different. In the illustrated embodiment, all female receivers 22 are the same which enables the smaller inner male projections 20" to have suitable misalignment tolerance, as described above.

Referring briefly to FIGS. 20A and 20B, two identical tiles 10*a* and 10*b* are shown interlocked together. Generally, the female receivers 22*b* and corresponding male projections 20*a* are adapted to each other in a complimentary manner to provide overlapping sections, or juxtaposed engagement surfaces, when joined together. These overlapping sections and juxtaposed engagement surfaces constrain movement in the three orthogonal X, Y and Z directions. This forms juxtaposed joints that enable the three-dimensional interlocking functionality.

As shown in the illustrated embodiment, the complimentary shape of the female receivers 22*b* to male projections 20*a* is such that horizontal gaps between the upper surfaces of adjacent tiles 10*a*, 10*b* are minimized. For example, in the illustrated embodiment, the male projections 10*a* have an upper surface 26 (FIGS. 7 and 8) that has a generally trapezoidal shape, and the female receivers 22*b* form a recessed cove having a corresponding trapezoidal shape. In exemplary embodiments, the horizontal gap between adjacent tiles 10*a* and 10*b*, when interlocked, is maintained to within about 0.5 inch (about 13 mm), as measured with a spherical anvil.

In addition, the vertical offset of upper surfaces between adjacent tiles 10*a*, 10*b* also may be minimized based on the arrangement of the male projections 20 and female receivers 22. As shown in the illustrated embodiment, for example, the upper surfaces 26 of the male projections 20*a* are in the same horizontal plane as the upper surface 12 of the major portion of the tile, and the female receivers 22*b* are adapted to fit the male projections 20*a* to also minimize vertical offset. The vertical interlocking functionality provided by the male projections 20*a* and female receivers 22*b* also constrains vertical movement of each tile relative to each other to minimize vertical offset at the intersection between adjacent tiles 10*a* and 10*b*. In exemplary embodiments, the vertical offset between adjacent interlocked tiles 10*a*, 10*b* is maintained to less than 0.25 inch (about 6 mm). Such horizontal and vertical constraint to within the above-mentioned limits is particularly advantageous to comply with certain regulations that may be required for wheelchair-bound or other disabled persons (e.g., according to the American with Disabilities Act).

Turning particularly to FIGS. 9-14, enlarged views of one of the exemplary male projections 20 is shown. The male projection 20 has a narrow male portion 30 proximal the front edge 16 of the tile, and a wide male portion 32 distal the front edge 16, such that the wide male portion 30 forms at least one wing 34 that extends beyond the narrow male portion 30 in a direction parallel to the adjacent side of the tile. In exemplary embodiments, the male projection 20 is configured to have a pair of wings 34 on opposite lateral sides of the projection 20, as shown. In the illustrated embodiment, the male projection 20 is tapered in the rearward longitudinal direction (−Y) from the wide male portion 30 toward the narrow male portion 32 to form tapered wings 34 having respective rearwardly and laterally outwardly facing surfaces 36 (tapered surfaces 36).

Turning to FIGS. 15-19, enlarged views of one of the exemplary female receivers 22 is shown. As shown, the female receiver 22 is recessed in the longitudinally forward direction (+Y) from the rear edge 18 and has a narrow female portion 38 proximal the rear edge 18, and a wide female portion 40 distal the rear edge 18, such that the wide female portion 38 forms at least one open pocket 42 of the female receiver. In exemplary embodiments, the female receiver 22 is configured to have a pair of such pockets 42 on opposite lateral sides of the receiver, as shown. In the illustrated embodiment, the female receiver 22 tapers in the rearward direction from the wide female 40 portion to the narrow female portion 38 to form tapered pockets 42 having respective forwardly-facing and laterally inwardly facing surfaces 44 (tapered surfaces 44). As shown, the tapered surfaces 44 of the female receiver 22 are formed in a complimentary fashion to the tapered surfaces 36 of the male projection 20.

Referring again to FIGS. 20A and 20B, when the first tile 10*a* is interlockingly connected with the other tile 10*b*, the wings 34 of the male projection 20*a* are received in the corresponding pockets 42 of the female receivers 22*b* to constrain movement of the tiles 10*a*, 10*b* in the longitudinal (Y) and lateral (X) directions along a horizontal plane. More particularly, as shown in the illustrated embodiment, the rearwardly and laterally outwardly facing surfaces 36 of the tapered wings 34 engage the forwardly-facing and laterally inwardly-facing surfaces 44 of the tapered pockets 42 to constrain at least the longitudinal movement (Y) of the tiles away from each other. The respective tapered surfaces 36, 44 also may constrain lateral movement (X) or such lateral movement may be constrained by laterally overlapping sections (e.g., respective corner regions 46, 48) of the wings 34 and pockets 42, or a combination thereof. The respective tapered surfaces 36, 44 can thereby provide two components of constraint (longitudinal and lateral, within a horizontal plane). Additionally, the cooperating male projections 20 and female receivers 22 also facilitate coupling adjacent tiles despite potential misalignment or manufacturing deviations.

Turning again to FIGS. 9-14, the enlarged views show that each male projection 20 also may have a thin wing portion 50 and a thick wing portion 52 in the vertical (Z) direction that forms a wing stop surface 54 (or engagement surface 54) at an elevation between the upper surface 26 and lower surface 27 of the male projection. More particularly, in the illustrated embodiment, each wing 34 is beveled in an upward vertical direction (Z) to reduce the thickness of each wing 34 in its laterally outward direction. The bevel of each wing 34 forms a downwardly and laterally outwardly facing wing stop surface 54 on each side that is configured to engage a corresponding surface of the female receiver 22.

Referring back to FIGS. 15-19, the enlarged views of the female receiver 22 show that each pocket 42 contains a pocket stop surface 56 that is adapted to engage a corresponding one of the wing stop surfaces 54 of the male projection 20. In the illustrated embodiment, the pocket stop surface 56 is formed by a beveled or tapered floor (also 56) that extends in the upward vertical direction to reduce the depth of the pocket 42 (increase the elevation of the floor 56) in the laterally outward direction. Generally, each pocket stop surface 56 is formed at an elevation within the pocket 42 that faces in an opposite vertical direction and in a complimentary manner to the wing stop surface 54.

Figure 21:
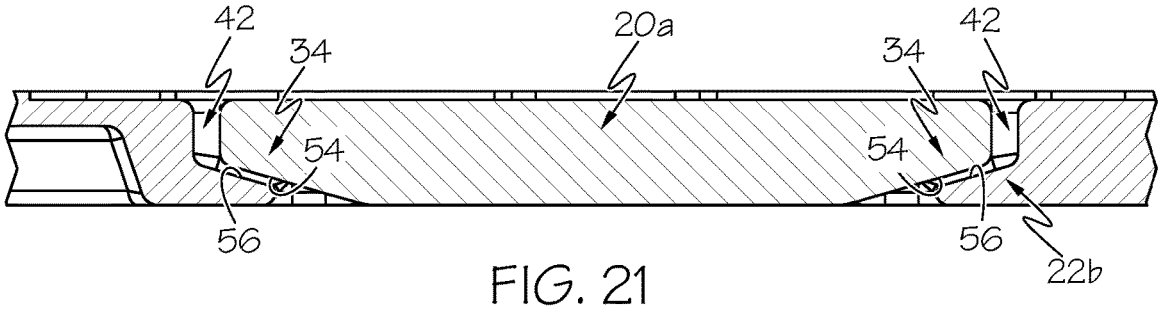
FIG. 21 is a cross-sectional view of interlocked members of the tiles taken about the line 21-21 in FIG. 20A.

Again referring to the interlocked state shown in FIGS. 20A and 20B, and more particularly to the cross-sectional view of FIG. 21, the wing stop surface 54 of the first tile 10*a* (which faces downwardly and laterally outwardly in the illustration) is shown engaging the pocket stop surface 56 of the second tile 10*b* (facing upwardly and laterally inwardly) to constrain vertical movement of the second tile 10*b*. As shown, the angle of the floor forming the pocket stop surface 56 is complimentary to the angle of the beveled surface forming the wing stop surface 54. These beveled surfaces 54, 56 permit some lateral movement that compensates for lateral misalignments during coupling. In addition, the stop surface (floor) 56 of the pocket 42 may extend laterally across only part of the pocket 42, as shown, to also compensate for longitudinal misalignment when interconnecting the tiles 10*a*, 10*b*.

To provide vertical constraint of the first tile 10*a* relative to the second tile 10*b*, the male projection 20 further includes a locking protrusion 60 that extends forwardly (+Y) from a front edge of the wide male portion 30, as shown in FIGS. 9-14. The locking protrusion 60 may be formed as a laterally extending ridge (also 60) that projects forwardly from the front edge of the male projection 20. The ridge 60 has a thickness in the vertical direction (Z) that is less than a maximum thickness of the wide male portion 30 and is located at a lower portion of the male projection 20 (e.g., below the middle). An upper surface of the protrusion (ridge) 60 forms a protrusion stop surface 62 that at least partially faces in an opposite vertical direction of the wing stop surface 54 (i.e., vertically in the illustration). The protrusion stop surface 62 is configured to engage a corresponding surface of the female receiver 22 to interlock the tiles in the vertical direction. In the illustrated embodiment, the ridge 60 has a rounded surface such that the protrusion stop surface 62 generally faces vertically upwardly and longitudinally forwardly.

As shown in FIGS. 15-19, the female receiver 22 includes a groove 64 that extends in the longitudinally forward direction (+Y) relative to the wide female portion 40. In the illustrated embodiment, the groove 64 is formed as a notch (also 64) at a lower forward edge of the female receiver 22 that is adapted to receive the protrusion 60 (e.g., ridge) of the male projection 20. The groove 64 has a groove stop surface 66 that at least partially faces vertically in an opposite vertical direction (e.g., downwardly in the illustration) relative to the facing direction of the protrusion stop surface 62 (e.g., upwardly in the illustration). In the illustrated embodiment, the notch 64 has a complimentary rounded surface to that of the ridge 60 such that the groove stop surface 66 faces vertically downwardly and longitudinally rearwardly. The curved surfaces 62, 66 of the notch 64 and ridge 60 facilitate coupling of tiles together, as described in further detail below.

Figure 22:
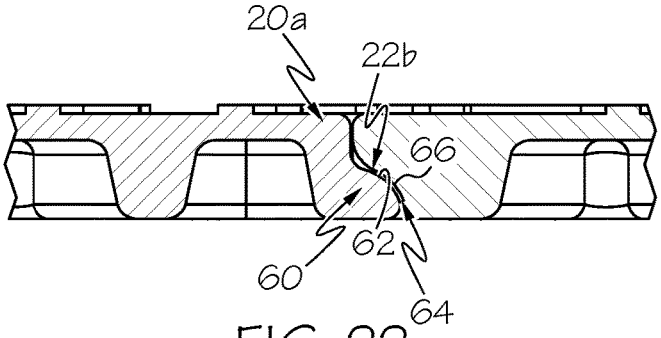
FIG. 22 is a cross-sectional view of interlocked members of the tiles taken about the line 22-22 in FIG. 20A.
Figure 23:
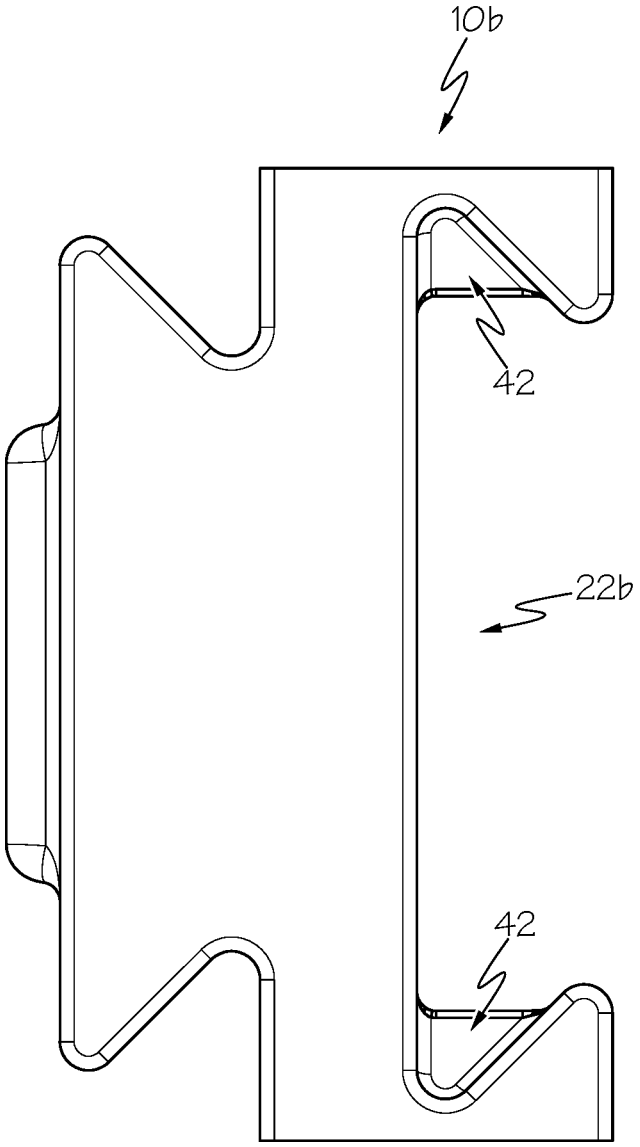
FIGS. 23-26 show exemplary states of interlocking the tiles according to an embodiment.

The interlocked state illustrated in FIGS. 20A and 20B, and particularly the cross-sectional view of FIG. 22, show the protrusion stop surface 62 of the first tile 10*a* engaging the groove stop surface 66 of the second tile 10*b* to constrain vertical movement of the first tile 10*a*. As described above, the respective wing stop surfaces 54 and pocket stop surfaces 56 constrain vertical movement of the second tile 10*b*. As such, when interlocked together via the male projection 20*a* and female receiver 22*b* arrangement, the tiles 10*a*, 10*b* are constrained from movement in all six perpendicular degrees of freedom.

Figure 24:
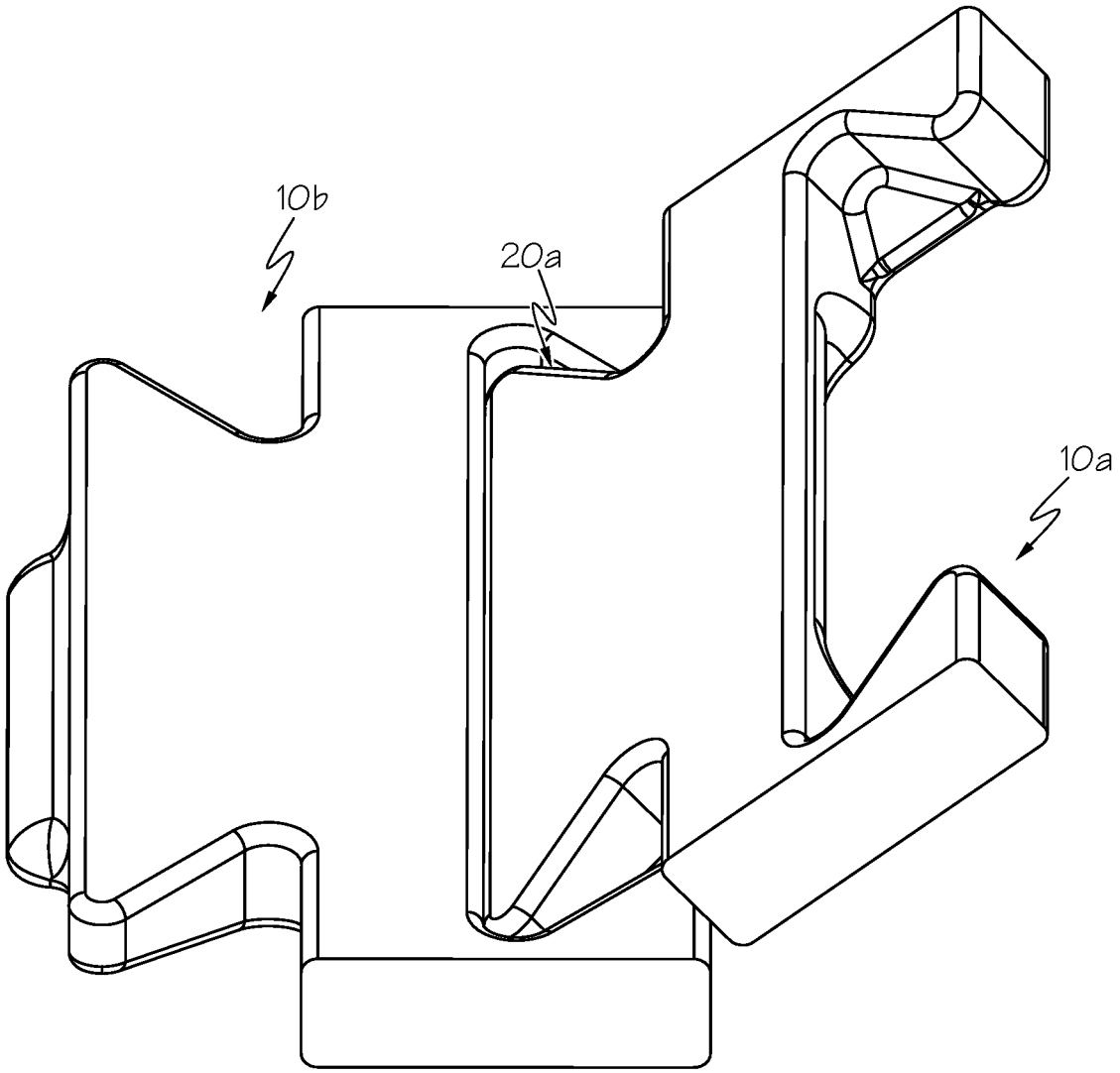
Figure 25:
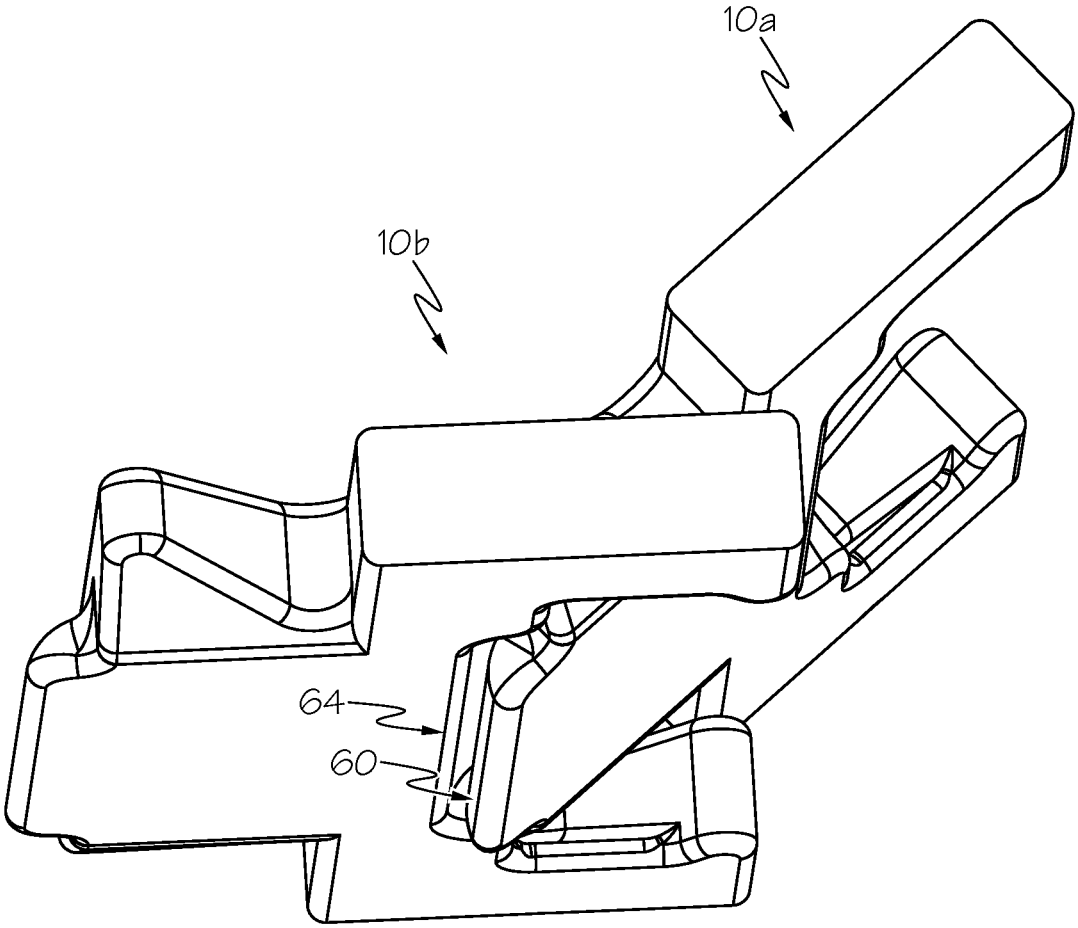

Turning now to FIGS. 23-26, an exemplary method of interlocking the modular tiles 10*a*, 10*b* together is shown. Starting with FIG. 23, the second modular tile 10*b* is placed on the ground with the upper surface 12 facing up. As shown in FIGS. 24 and 25, the first modular tile 10*a* approaches the second modular tile 10*b* at an incline so that the forwardly protruding ridge 60 of the first tile male projection 20*a* is at least partially received in the notch 64 of the second tile female receiver 22*b*. The notch 64 and ridge 60 being located at respective lower areas of the female receiver 22*b* and male projection 20*a* facilitate the start of the interlocking process while the second tile 10*b* remains on the ground (e.g., without raising the second tile 10*b*).

Figure 26:
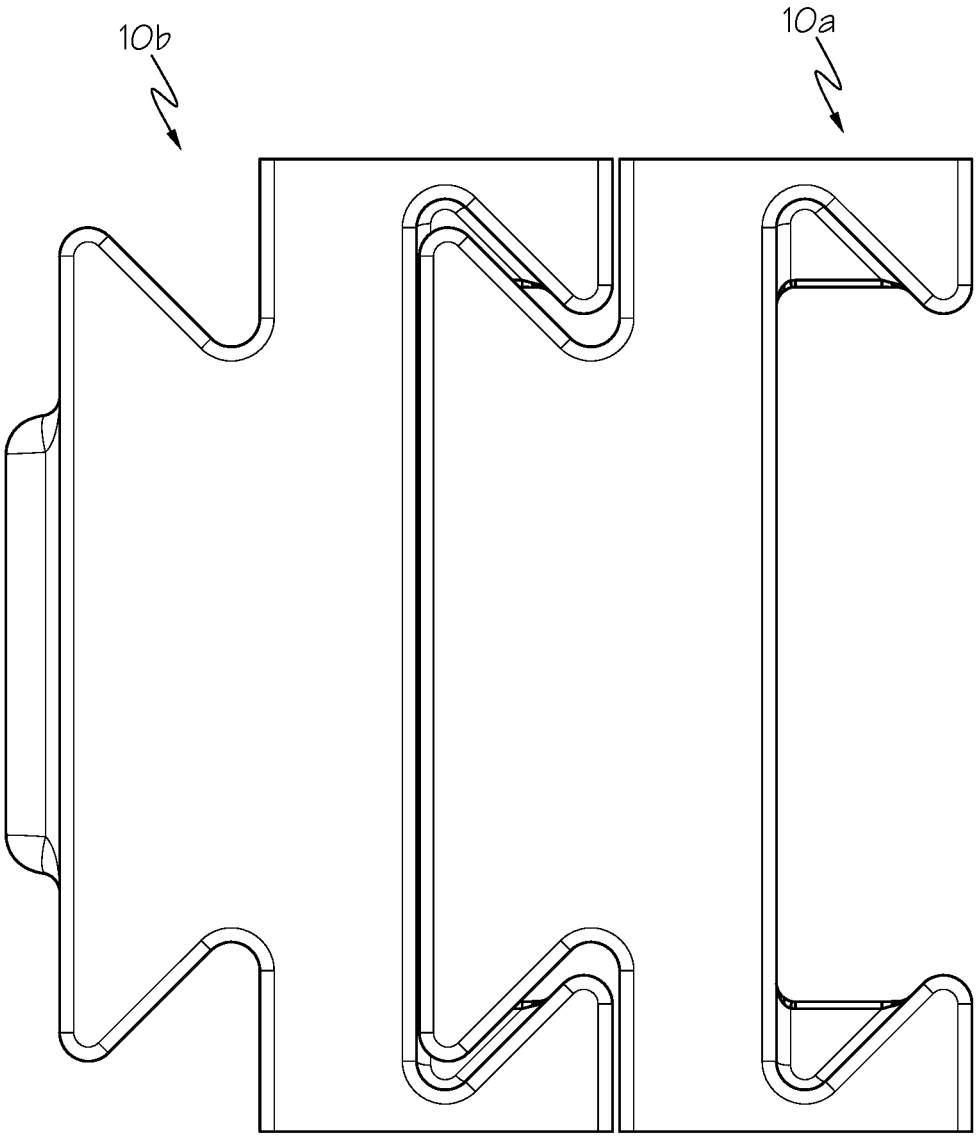

FIG. 26 shows the following step in which the first tile 10*a* is rotated toward the ground with the region of the notch 64 serving generally as a pivot axis. The respective rounded surfaces 62, 66 of the notch 64 and ridge 60 facilitate insertion and rotation. Once the rotation is complete and the first tile 10*a* is laying on the ground (as shown), the ridge 60 of the first tile male projection 20*a* underlies the notch 64 of the second tile female receiver 22*b*. At this point, the first tile 10*a* is vertically constrained because if the first tile 10*a* is raised directly vertically (without pivoting back the way it came), the protrusion stop surface 62 of the ridge 60 will engage the groove top surface 66 of the notch 64.

In the illustrated state, the wings 34 also are received in the pockets 42. Again, the tapered surface 36 of each wing 34 and complimentary tapered surface 44 of each pocket 42 facilitates alignment and insertion. In this state, the wing stop surfaces 54 overlie the pocket stop surfaces 56. As such, the second tile 10*b* is vertically constrained because attempting to directly vertically raise the second tile 10*b* will cause the wing stop surfaces 54 and pocket stop surfaces 56 to engage. The beveled wing stop surfaces 54 on the underside of the wings 34 and the corresponding beveled pocket stop surfaces 56 in the pockets 42 facilitate alignment as the first tile 10*a* is inserted into the second tile 10*b*. The juxtaposition of the wings 34 and pockets 42 in the interlocked state also constrains the longitudinal (forward and reverse) movement and lateral (side-to-side) movement via corresponding tapered surfaces, corners, forward and rearward edges, as is apparent in the illustrated view. To uninstall the tiles 10*a*, 10*b*, the operation is performed in reverse.

Figure 27:
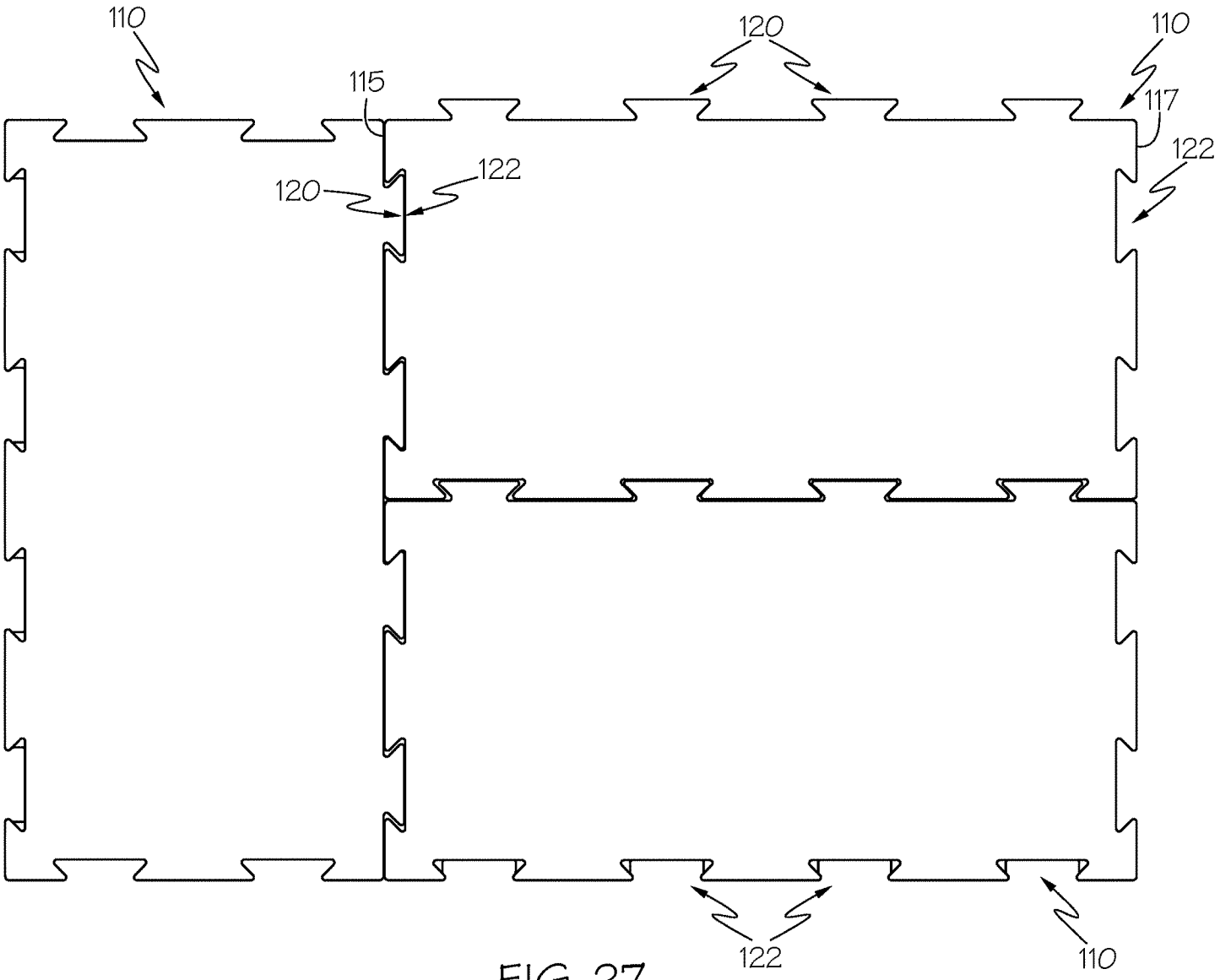
FIG. 27 is a top plan view of another exemplary modular tile interlocked with other tiles according to an embodiment.

Turning to FIG. 27, another exemplary embodiment of a series modular interlocked tiles 110 is shown. The tile 110 is substantially the same as the above-referenced tile 10, and consequently the same reference numerals are indexed by 100 to denote structures corresponding to similar structures in tile 10. The difference with the tile 110 is that the lateral side edges 115, 117 of the tile 110 contain interlocking elements, which are female receivers 122 in the illustrated embodiment, but could be male projections 120. The foregoing description of the tile 10 is equally applicable to the tile 110, and aspects of the tiles 10, 110 may be substituted for one another or used in conjunction with one another where applicable.

Thus, exemplary modular tiles for a walkway system have been described herein. Generally, the modular tile is configured to interlock with another tile to constrain movement of the interlocked tiles in all three-orthogonal dimensions. The tile includes a male projection which may be tapered to provide lateral wings that are received in corresponding pockets of a female receiver of the other tile. The wings may include vertically-facing male stop surfaces that are engageable with vertically-facing female stop surfaces within the pockets. The male projection may further include a forwardly protruding ridge that is received in a corresponding groove of the female receiver of the other tile. The engagement of the stop surfaces of the wings and pockets, and the engagement of the ridge in the groove is such that the tiles are vertically interlocked with each other. The tiles may be configured to enable pivotable interlocking connection while one tile remains on the ground.

While exemplary forms of the modular interlocking tiles 10, 110 have been described above, it should be apparent that alternative configurations also could be employed. For example, although two wings 34 and two pockets 42 are show, the tiles could include one wing 34 and one corresponding pocket 42. In addition, although the surfaces 36 and 44 are shown as being tapered, the surfaces 54 and 56 are shown as being beveled, and the surfaces 62, 66 are shown as rounded; one or more of these respective surfaces may be stepped with squared edges, or have any other suitable form. In addition, although the protrusion 60 (e.g., ridge) and groove 64 (e.g., notch) are shown located at a lower part of the respective male projection 20 and female receiver 22, these portions also could be located at intermediate elevations; although the lower elevation facilitates the insertion and pivotal rotation while one tile remains on the ground as described above.

It is understood that although such surfaces or structures are described herein as "facing" or "extending" in a particular vertical, lateral, or longitudinal direction, such surfaces or structures do not necessarily require absolute facing or extending in such direction, unless otherwise noted. For example, a rearwardly-facing surface could be a tapered surface that faces both rearwardly and laterally outwardly; or a vertically-facing surface could be a beveled or rounded surface having a vertical facing component as well as another directional component. In addition, a vertically-extending surface could be a curved or inclined surface. A surface or structure that faces or extends in the stated direction may have a major component of such direction (e.g., at least 50%), unless otherwise noted. Such examples are apparent in view of the foregoing detailed description of such surfaces or structures.

According to an aspect, a modular interlocking tile for a walkway system, includes: a lower surface, an upper surface, a front edge, a rear edge, and lateral side edges extending between the front edge and the rear edge, the lower and upper surfaces extending horizontally, and the front, rear and lateral side edges extending vertically to operatively connect the upper and lower surfaces; at least one male projection that horizontally projects in a longitudinally forward direction from the front edge, the male projection having a narrow male portion proximal the front edge and a wide male portion distal the front edge, the narrow male portion being narrower in a laterally horizontal direction than the wide male portion, such that the wide male portion forms at least one wing on at least one lateral side of the male projection, wherein the male projection further includes a locking protrusion that horizontally extends forwardly from a front edge of the wide male portion, the locking protrusion including a protrusion stop surface that at least partially faces vertically; at least one female receiver that is horizontally recessed in the longitudinally forward direction from the rear edge, the female receiver having a narrow female portion proximal the rear edge and a wide female portion distal the rear edge, the narrow female portion being narrower in the laterally horizontal direction than the wide female portion, such that the wide female portion forms at least one open pocket on at least one lateral side of the female receiver, wherein the female receiver further includes a groove that horizontally extends in the longitudinally forward direction relative to the wide female portion, the groove having a groove stop surface that at least partially faces vertically in an opposite vertical direction than the protrusion stop surface; wherein the tile is adapted to interlockingly connect with another tile, such that: (i) the at least one wing of the male projection of the tile is receivable in the at least one pocket of the female receiver of the other tile to interlock the tiles in the longitudinal and lateral directions within a horizontal plane, and (ii) the protrusion stop surface of the tile is engageable with the groove stop surface of the other tile to interlock the tiles in the vertical direction.

Embodiments may include one or more of the following additional features, separately or in any combination.

In some embodiments, the at least one wing of the male protrusion forms a wing stop surface that faces in an opposite vertical direction as the protrusion stop surface.

In some embodiments, the at least one pocket of the female receiver contains a pocket stop surface that faces in an opposite vertical direction as the groove stop surface.

In some embodiments, the tile is adapted to interlockingly connect with the other tile, such that the wing stop surface of the tile is engageable with the pocket stop surface of the other tile to interlock the tiles in another vertical direction.

In some embodiments, the wing stop surface faces at least partially vertically downwardly.

In some embodiments, the protrusion stop surface faces at least partially vertically upwardly.

In some embodiments, the groove stop surface faces at least partially vertically downwardly.

In some embodiments, the pocket stop surface faces at least partially vertically upwardly.

In some embodiments, the at least one wing includes wings on lateral outward sides of the male protrusion.

In some embodiments, the at least one pocket includes pockets on lateral outward sides of the female receiver.

In some embodiments, the male projection horizontally tapers in a rearward longitudinal direction from the wide male portion to the narrow male portion to form a laterally outwardly and rearwardly-facing male engagement surface.

In some embodiments, the female receiver horizontally tapers in the rearward direction from the wide female portion to the narrow female portion of the female receiver to form a laterally inwardly and forwardly-facing female engagement surface.

In some embodiments, the wing stop surface is a beveled surface that reduces the thickness of the at least one wing in a laterally outward direction.

In some embodiments, the pocket stop surface is a beveled surface that reduces the depth of the pocket in the laterally outward direction.

In some embodiments, the protrusion stop surface is a rounded surface that faces vertically upwardly and longitudinally forwardly.

In some embodiments, the groove stop surface is a rounded surface that faces vertically downwardly and longitudinally rearwardly.

In some embodiments, the protrusion of the male projection is a ridge having a thickness that is less than a maximum thickness of the male protrusion, and extends laterally between the wings.

In some embodiments, the ridge is at a lower portion of the male projection.

In some embodiments, the groove of the female receiver is a notch in the lower surface of the tile.

In some embodiments, an upper surface of the male projection is coplanar with the upper surface of the tile.

In some embodiments, the lower surface of the male projection is coplanar with the lower surface of the tile.

In some embodiments, the male projection is complimentarily shaped to the female receiver such that when the tile is interlocked with the other tile, all horizontal gaps between tiles is less than 0.5 inches as measured with a spherical anvil.

In some embodiments, the vertical constraint between tile is maintained to less than 0.25 inches between tiles.

In some embodiments, the at least one male projection includes a plurality of male projections laterally spaced across the forward edge, and wherein the at least one female receiver includes a plurality of female receivers.

In some embodiments, the plurality of male projections includes laterally outward male projections, each having a lateral width that is greater than an intermediate male projection between the laterally outward male projections.

In some embodiments, the upper surface has treads.

In some embodiments, wherein the lower surface has treads.

According to another aspect, a walkway system includes: the tile according to any of the preceding or following, interlocked with another tile.

In some embodiments, the tile and other tile are respectively shaped and sized such that when the tile is laying on the ground, the male projection of the other tile can be received vertically at an inline into the female receiver of the tile, and is pivotable about a horizontal axis to interlock the tiles together.

According to another aspect, a modular interlocking tile for walkway system, includes: a lower surface, an upper surface, a front edge, a rear edge, and lateral side edges, the lower and upper surfaces extending horizontally, and the front, rear and lateral side edges extending vertically to operatively connect the upper and lower surfaces; at least one tapered male projection that horizontally projects in a forward longitudinal direction from the front edge and horizontally tapers in a rearward longitudinal direction from a wide male portion to a narrow male portion of the male projection, the wide male portion forming wings on opposite lateral sides of the male projection, each wing being beveled in an upward vertical direction to reduce the thickness of each wing in its laterally outward direction and forming a downwardly and laterally outwardly facing wing stop surface at an elevation in a vertical direction between an upper and lower surface of the male projection, wherein the male projection further includes a laterally extending ridge that horizontally projects forwardly from a front edge of the wide male portion, the ridge having a thickness in the vertical direction that is less than a maximum thickness of the wide male portion and being located at a lower portion of the male projection, the ridge forming a upwardly facing ridge stop surface at an elevation in the vertical direction between the upper and lower surface of the male projection, the ridge stop surface being longitudinally offset in the forward direction from the wing stop surface; at least one tapered female receiver that is recessed in the forward direction from the rear edge and horizontally tapers in the rearward direction from a wide female portion to a narrow female portion of the female receiver, the wide female portion forming open pockets on opposite lateral sides of the female receiver, each pocket having a floor within at least part of the pocket that is beveled in an upward vertical direction to reduce the depth of the pocket in its laterally outward direction and forming an upwardly and laterally inwardly facing pocket stop surface at an elevation in the vertical direction within the pocket, wherein the female receiver further includes a notch in a lower portion of the tile that extends in the forward direction relative to the wide female portion, the notch forming a downwardly facing notch stop surface, wherein the notch stop surface is longitudinally offset in the forward direction from the pocket stop surface.

Embodiments may include one or more of the features of the foregoing aspect, separately or in any combination.

According to another aspect, a modular interlocking tile includes: at least one male projection that projects horizontally in a longitudinally forward direction from a front edge of the tile, the male projection having a rearwardly-facing male engagement surface, opposite laterally-facing male engagement surfaces, and a vertically-facing male stop surface; at least one female receiver that is recessed in the longitudinally forward direction from a rear edge of the tile, the female receiver having a forwardly-facing female engagement surface, opposite laterally-facing female engagement surfaces, and at least one vertically-facing female stop surface that faces in an opposite vertical direction of the vertically-facing male stop surface; wherein the tile is adapted to interlockingly connect with another tile, such that: (i) the rearwardly-facing male engagement surface of the tile is engageable with the forwardly-facing female engagement surface of the other tile to interlock the tiles in the longitudinal direction along a horizontal plane, (ii) the opposite laterally-facing male engagement surfaces of the tile are respectively engageable with the opposite laterally-facing female engagement surfaces of the other tile to interlock the tiles in the lateral direction along the horizontal plane, and (iii) the vertically-facing male stop surface of the tile is engageable with the vertically-facing female stop surface of the other tile to interlock the tiles in the vertical direction.

Embodiments may include one or more features of the foregoing aspect and/or one or more of the following additional features, separately or in any combination.

In some embodiments, the at least one male protrusion includes another vertically-facing male stop surface that faces in an opposite vertical direction as the at least one vertically-facing male stop surface.

In some embodiments, the female receiver faces includes another vertically-facing female stop surface that faces in an opposite vertical direction as the at least one vertically-facing female stop surface.

In some embodiments, the tile is adapted to interlockingly connect with another tile, such that: the other vertically-facing male stop surface of the tile is engageable with the other vertically-facing female stop surface of the other tile, such that the interlocked tiles are constrained from movement in six perpendicular degrees of freedom.

According to another aspect, a walkway system includes a plurality of tiles interlocked together via at least one joint, the at least one joint including at least one male locking element and at least one female locking element in juxtaposed relationship that includes each of juxtaposed axially overlapping sections, juxtaposed laterally overlapping sections, and juxtaposed vertically overlapping sections that interlock the plurality of tiles in all three orthogonal dimensions.

In some embodiments, the at least one joint has a pivot axis that enables the tiles to be interlockingly coupled together or disconnected, and wherein when interlocked the tiles are constrained from movement in six perpendicular degrees of freedom.

An "operative connection," or a connection by which entities are "operatively connected," is one in which the entities are connected in such a way that the entities may perform as intended. An operative connection may be a direct connection or an indirect connection in which an intermediate entity or entities cooperate or otherwise are part of the connection or are in between the operatively connected entities. An operative connection or coupling may include the entities being integral and unitary with each other.

It is to be understood that terms such as "top," "bottom," "upper," "lower," "left," "right," "front," "rear," "forward," "rearward," and the like as used herein may refer to an arbitrary frame of reference, rather than to the ordinary gravitational frame of reference.

It is to be understood that all ranges and ratio limits disclosed in the specification and claims may be combined in any manner. It is to be understood that unless specifically stated otherwise, references to "a," "an," and/or "the" may include one or more than one, and that reference to an item in the singular may also include the item in the plural.

The term "about" as used herein refers to any value which lies within the range defined by a variation of up to +10% of the stated value, for example, ±10%, ±9%, ±8%, ±7%, ±6%, ±5%, ±4%, ±3%, ±2%, ±1%, ±0.01%, or +0.0% of the stated value, as well as values intervening such stated values.

The phrase "and/or" should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified unless clearly indicated to the contrary. Thus, as a non-limiting example, a reference to "A and/or B," when used in conjunction with open-ended language such as "comprising" can refer, in one embodiment, to A without B (optionally including elements other than B); in another embodiment, to B without A (optionally including elements other than A); in yet another embodiment, to both A and B (optionally including other elements); etc.

The word "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," may refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

The transitional words or phrases, such as "comprising," "including," "carrying," "having," "containing," "involving," "holding," and the like, are to be understood to be open-ended, i.e., to mean including but not limited to.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A modular interlocking tile for a walkway system, comprising:

a lower surface, an upper surface, a front edge, a rear edge, and lateral side edges extending between the front edge and the rear edge, the lower and upper surfaces extending horizontally, and the front, rear and lateral side edges extending vertically to operatively connect the upper and lower surfaces;

at least one male projection that horizontally projects in a longitudinally forward direction from the front edge, wherein:

the male projection includes a narrow male portion proximal the front edge and a wide male portion distal the front edge, the narrow male portion is narrower in a laterally horizontal direction than the wide male portion, such that the wide male portion forms at least one wing on at least one lateral side of the male projection, the male projection further includes a locking protrusion adjacent the at least one wing that horizontally extends forwardly from a front edge of the wide male portion, and the locking protrusion includes a protrusion stop surface that at least partially faces vertically; and at least one female receiver that is horizontally recessed in the longitudinally forward direction from the rear edge, wherein:

the female receiver includes a narrow female portion proximal the rear edge and a wide female portion distal the rear edge, the narrow female portion is narrower in the laterally horizontal direction than the wide female portion, such that the wide female portion forms at least one open pocket on at least one lateral side of the female receiver, the female receiver further includes a groove adjacent the at least one open pocket that horizontally extends in the longitudinally forward direction relative to the wide female portion, and the groove includes a groove stop surface that at least partially faces vertically in an opposite vertical direction than the protrusion stop surface;

wherein the tile is adapted to interlockingly connect with another tile, such that: (i) the at least one wing of the male projection of the tile is receivable in the at least one pocket of the female receiver of the other tile to interlock the tiles in the longitudinal and lateral directions within a horizontal plane, and (ii) the protrusion stop surface of the tile is engageable with the groove stop surface of the other tile to interlock the tiles in the vertical direction, wherein the protrusion stop surface is a rounded surface that faces vertically upwardly and longitudinally forwardly, and wherein the groove stop surface is a rounded surface that faces vertically downwardly and longitudinally rearwardly.

2. The tile according to claim 1, wherein the at least one wing of the male projection forms a wing stop surface that faces in an opposite vertical direction as the protrusion stop surface, wherein the at least one pocket of the female receiver contains a pocket stop surface that faces in an opposite vertical direction as the groove stop surface, and wherein the tile is adapted to interlockingly connect with the other tile, such that the wing stop surface of the tile is engageable with the pocket stop surface of the other tile to interlock the tiles in another vertical direction.

3. The tile according to claim 2, wherein the wing stop surface is a beveled surface that reduces the thickness of the at least one wing in a laterally outward direction, and wherein the pocket stop surface is a beveled surface that reduces the depth of the pocket in the laterally outward direction.

4. The tile according to claim 2, wherein the male projection is complimentarily shaped to the female receiver such that when the tile is interlocked with the other tile, all horizontal gaps between tiles is less than 0.5 inches as measured with a spherical anvil, and the vertical constraint between tile is maintained to less than 0.25 inches between tiles.

5. The tile according to claim 1, wherein the wing stop surface faces at least partially vertically downwardly;

wherein the protrusion stop surface faces at least partially vertically upwardly;

wherein the groove stop surface faces at least partially vertically downwardly; and wherein the pocket stop surface faces at least partially vertically upwardly.

6. The tile according to claim 1, wherein the at least one wing includes wings on lateral outward sides of the male projection, and wherein the at least one pocket includes pockets on lateral outward sides of the female receiver.

7. The tile according to claim 6, wherein the protrusion of the male projection is a ridge having a thickness that is less than a maximum thickness of the male projection, and extends laterally between the wings.

8. The tile according to claim 7, wherein the ridge is at a lower portion of the male projection.

9. The tile according to claim 8, wherein the groove of the female receiver is a notch in the lower surface of the tile.

10. The tile according to claim 1, wherein the male projection horizontally tapers in a rearward longitudinal direction from the wide male portion to the narrow male portion to form a laterally outwardly and rearwardly-facing male engagement surface, and wherein the female receiver horizontally tapers in the rearward direction from the wide female portion to the narrow female portion of the female receiver to form a laterally inwardly and forwardly-facing female engagement surface.

11. The tile according to claim 1, wherein an upper surface of the male projection is coplanar with the upper surface of the tile, and wherein a lower surface of the male projection is coplanar with the lower surface of the tile.

12. The tile according to claim 1, wherein the at least one male projection includes a plurality of male projections laterally spaced across the forward edge, and wherein the at least one female receiver includes a plurality of female receivers, and wherein the plurality of male projections includes laterally outward male projections, each having a lateral width that is greater than an intermediate male projection between the laterally outward male projections.

13. The tile according to claim 1, wherein the upper surface has treads and wherein the lower surface has treads.

14. A walkway system comprising:

the tile according to claim 1, interlocked with another tile.

15. The walkway system according to claim 14, wherein the tile and other tile are respectively shaped and sized such that when the tile is laying on the ground, the male projection of the other tile can be received vertically at an inline into the female receiver of the tile, and is pivotable about a horizontal axis to interlock the tiles together.

16. The walkway system according to claim 15, wherein the tile and the other tile are interlocked via at least one joint, wherein the at least one joint has a pivot axis that enables the tiles to be interlockingly coupled together or disconnected, and wherein when interlocked the tiles are constrained from movement in six perpendicular degrees of freedom.

17. A modular interlocking tile for walkway system, comprising:

a lower surface, an upper surface, a front edge, a rear edge, and lateral side edges, the lower and upper surfaces extending horizontally, and the front, rear and lateral side edges extending vertically to operatively connect the upper and lower surfaces;

at least one tapered male projection that horizontally projects in a forward longitudinal direction from the front edge and horizontally tapers in a rearward longitudinal direction from a wide male portion to a narrow male portion of the male projection, wherein:

the wide male portion includes wings on opposite lateral sides of the male projection, each wing is beveled in an upward vertical direction to reduce the thickness of each wing in its laterally outward direction and forming a downwardly and laterally outwardly facing wing stop surface at an elevation in a vertical direction between an upper and lower surface of the male projection, the male projection further includes a laterally extending ridge that horizontally projects forwardly from a front edge of the wide male portion, the ridge has a thickness in the vertical direction that is less than a maximum thickness of the wide male portion and being located at a lower portion of the male projection, the ridge includes an upwardly facing ridge stop surface at an elevation in the vertical direction between the upper and lower surface of the male projection, the ridge stop surface is longitudinally offset in the forward direction from the wing stop surface; and at least one tapered female receiver that is recessed in the forward direction from the rear edge and horizontally tapers in the rearward direction from a wide female portion to a narrow female portion of the female receiver, wherein:

the wide female portion includes open pockets on opposite lateral sides of the female receiver, each pocket has a floor within at least part of the pocket that is beveled in an upward vertical direction to reduce the depth of the pocket in its laterally outward direction and forming an upwardly and laterally inwardly facing pocket stop surface at an elevation in the vertical direction within the pocket, the female receiver further includes a notch in a lower portion of the tile that extends in the forward direction relative to the wide female portion, the notch includes a downwardly facing notch stop surface, and the notch stop surface is longitudinally offset in the forward direction from the pocket stop surface.

18. A modular interlocking tile, comprising:

at least one male projection that projects horizontally in a longitudinally forward direction from a front edge of the tile, wherein the male projection includes a rearwardly-facing male engagement surface, opposite laterally-facing male engagement surfaces, and a vertically-facing male stop surface; and at least one female receiver that is recessed in the longitudinally forward direction from a rear edge of the tile, wherein the female receiver includes a forwardly-facing female engagement surface, opposite laterally-facing female engagement surfaces, and at least one vertically-facing female stop surface that faces in an opposite vertical direction of the vertically-facing male stop surface;

wherein the tile is adapted to interlockingly connect with another tile, such that:

(i) the rearwardly-facing male engagement surface of the tile is engageable with the forwardly-facing female engagement surface of the other tile to interlock the tiles in the longitudinal direction along a horizontal plane, (ii) the opposite laterally-facing male engagement surfaces of the tile are respectively engageable with the opposite laterally-facing female engagement surfaces of the other tile to interlock the tiles in the lateral direction along the horizontal plane, and (iii) the vertically-facing male stop surface of the tile is engageable with the vertically-facing female stop surface of the other tile to interlock the tiles in the vertical direction wherein the tile includes an upper surface and a lower surface, wherein an upper surface of the at least one male projection is coplanar with the upper surface of the tile, and wherein a lower surface of the at least one male projection is coplanar with the lower surface of the tile.

19. The tile according to claim 18, wherein the at least one male projection includes another vertically-facing male stop surface that faces in an opposite vertical direction as the at least one vertically-facing male stop surface, wherein the female receiver faces includes another vertically-facing female stop surface that faces in an opposite vertical direction as the at least one vertically-facing female stop surface, and wherein the tile is adapted to interlockingly connect with another tile, such that:

the other vertically-facing male stop surface of the tile is engageable with the other vertically-facing female stop surface of the other tile, such that the interlocked tiles are constrained from movement in six perpendicular degrees of freedom.

* * * * *